US006523644B2

(12) United States Patent
Apostolopoulos

(10) Patent No.: US 6,523,644 B2
(45) Date of Patent: Feb. 25, 2003

(54) SCAFFOLDING FOR BRIDGES AND OTHER STRUCTURES

(75) Inventor: Lambros Apostolopoulos, Amherst, NY (US)

(73) Assignee: Paul Kristen, Inc., Tonawanda, NY (US)

( * ) Notice: Subject to any disclaimer, the term of this patent is extended or adjusted under 35 U.S.C. 154(b) by 0 days.

(21) Appl. No.: 10/090,501

(22) Filed: Mar. 4, 2002

(65) Prior Publication Data

US 2002/0092706 A1 Jul. 18, 2002

Related U.S. Application Data

(60) Division of application No. 09/899,312, filed on Jul. 5, 2001, which is a division of application No. 09/645,242, filed on Aug. 24, 2000, now Pat. No. 6,264,002, which is a continuation-in-part of application No. 08/888,271, filed on Jul. 3, 1997, now Pat. No. 6,138,793, which is a continuation-in-part of application No. 08/506,685, filed on Jul. 25, 1995, now Pat. No. 5,730,248.

(51) Int. Cl.[7] ..... E04G 3/10
(52) U.S. Cl. ..... 182/222; 182/150
(58) Field of Search ..... 182/150, 138, 182/222, 223

(56) References Cited

U.S. PATENT DOCUMENTS 4,313,636 A * 2/1982 Deeds ..... 160/93
4,594,826 A * 6/1986 Gray ..... 174/48
4,828,312 A * 5/1989 Kinkel
4,967,944 A * 11/1990 Waters ..... 224/404

* cited by examiner

*Primary Examiner*—Alvin Chin-Shue
(74) *Attorney, Agent, or Firm*—James C. Simmons

(57) ABSTRACT

A work platform for use on bridges or other structures wherein a plurality of cables extend in spaced relation along a section of the structure and are supported by the structure and wherein a floor comprising a plurality of corrugated flooring panels or sections is supported on the cables and removably secured to the cables. The positions of the cables are adjustable in vertical and horizontal directions. A connector assembly releasably connects each of the platform flooring sections to a respective supporting cable on which it rests. Each connector assembly comprises a first part which rests on a bottom wall of the panel and has a portion which extends through an opening in the bottom wall and back through the opening and is connected to a second part to form an eyelet through which the cable passes. In aspects of the present invention, the first and second parts are connected by a lever or a wedge. The corrugated decking panels have hinged plates for covering the corrugations to provide a substantially flat surface over the panels while allowing nestability for storage and transport. In one aspect of the invention, a pair of floors are connected by a gutter and are inclined therefrom, and the cable positions are adjustable to vary the angle of inclination as well as to vary the height and spacing of the cables. The inclined floors are vibrated to effect removal of debris to the gutter where it may be more easily removed.

4 Claims, 18 Drawing Sheets

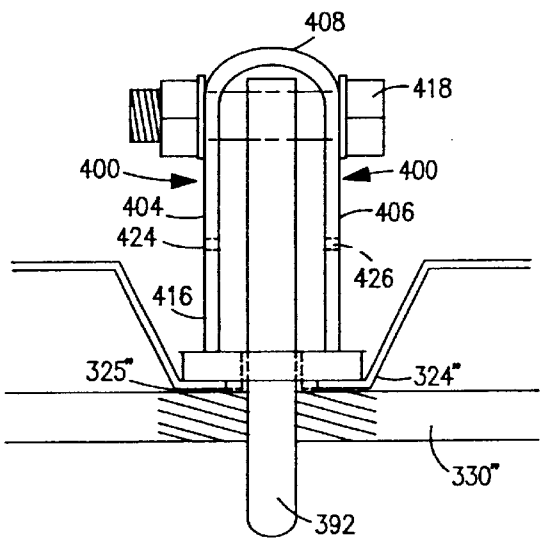
FIG. 22
FIG. 21
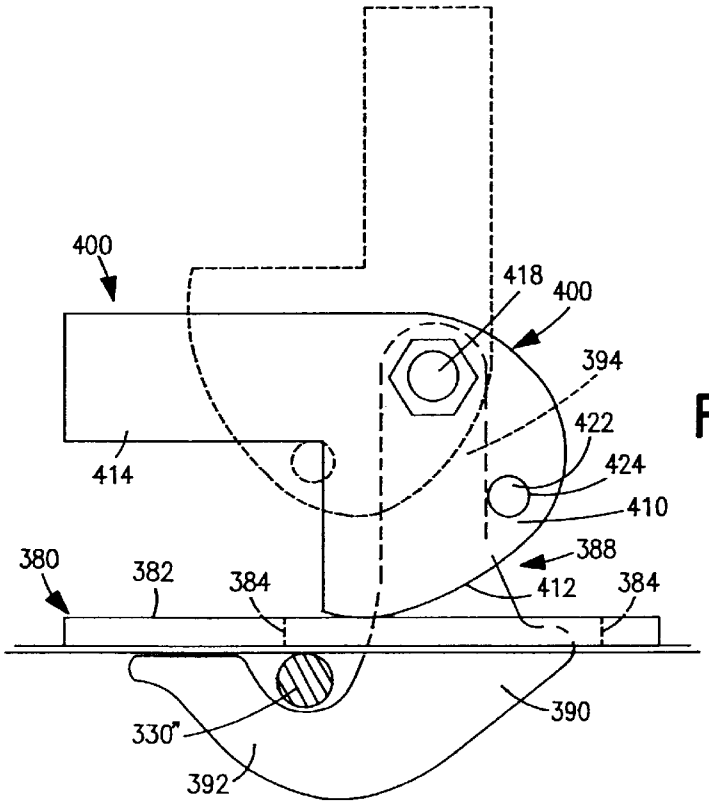
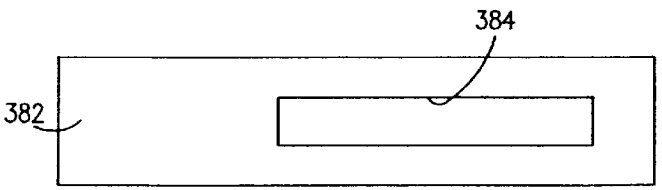
FIG. 23

SCAFFOLDING FOR BRIDGES AND OTHER STRUCTURES

This application is a divisional of my application Ser. No. 09/899,312, filed Jul. 5, 2001, which is a divisional of my application Ser. No. 09/64.5,242, filed Aug. 24, 2000 (now U.S. Pat. No. 6,264,002), which is a continuation-in-part of my application Ser. No. 08/888,271, filed Jul. 3, 1997 (now U.S. Pat. No. 6,138,793), which is a continuation-in-part of my application Ser. No. 08/506,685, filed Jul. 25, 1995 (now U.S. Pat. No. 5,730,248), the disclosures of which applications are hereby incorporated herein by reference.

This invention relates to the art of working platforms for supporting persons performing work on structures, and more particularly to a new and improved work platform installed below the deck or roadway of a bridge or next to a building or other structure. It is necessary to periodically clean, repaint, and rehabilitate the surfaces of steel bridges to prevent corrosion and deterioration of the steel supporting structure. This, in turn, creates the need to provide a safe and effective support for workmen performing the cleaning and painting of the surfaces beneath the deck or roadway of the bridge, along with concrete removal. In addition, environmental concerns and regulations give rise to the need for containing the debris from the cleaning operation as well as paint residue and spillage.A number of work platforms for bridges have been proposed, but many are complex structures and time consuming to erect and dismantle. Other prior art platforms are not sufficiently rigid or are limited in height, i.e., the distance between platform flooring and bridge steel structure, due to the manner in which they are attached to the bridge. Some prior platforms extend for only a short distance longitudinally of the bridge and are limited in that respect.

It would, therefore, be highly desirable to provide a new and improved work platform for use on bridges which is safe, provides a sufficiently rigid support for workmen standing and walking thereon, which is simple in structure, light in weight, and therefore quick, easy, and economical to erect and dismantle, extends for a significant portion of the length of the bridge, and which is effective in containing debris from the cleaning and painting operations performed on the bridge.

A typical bridge includes a deck or roadway and steel structure therebelow which is supported on spaced-apart concrete abutments or piers or other structures. It would be highly desirable to provide a work platform which can be connected to such bridge structures with the platform in an optimum work position (even on bridges with skewed or angled sections).

It also would be highly desirable to provide a work platform wherein platform flooring panels are secured in place in a safe yet easily removable manner.

It would also be highly desirable to provide a work platform wherein debris may be removed therefrom easily and effectively.

It would further be highly desirable use corrugated panels but such as to provide a flat floor surface on workers to work on yet such that the panels are compactly stackable for storage and transport.

In accordance with the present invention, a work platform is provided for use on bridges wherein a plurality of cables extend along a section of the bridge in spaced relation below the deck or roadway and steel support structure of the bridge, which cables are supported at opposite ends by either the steel support structure of the bridge or by the spaced-apart vertical piers of the bridge, and wherein a plurality of platform flooring panels or sections are supported on the cables, extend laterally of the cables, are arranged side-by-side along the section of the bridge such as between the piers and are removably secured to the cables.

In accordance with one aspect of the present invention, means are provided for adjusting the height of the platform and the positions or spacings between the cables.

In accordance with another aspect of the present invention, platform flooring panels are corrugated to maximize the strength-to-weight ratio of the platform flooring. Flat cover members are hingedly connected to the panels to cover the corrugations respectively so as to provide a flat surface for walking on while allowing the panels to be compactly stacked.

In accordance with another aspect of the present invention, Each of the platform flooring sections is releasably connected at spaced locations to the supporting cables on which it rests. This is provided by connector assemblies comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris. One embodiment of such a connector assembly has a manually operated lever for selectively placing the connector assembly in clamped or unclamped positions relative to the cable and flooring section.

The foregoing and additional advantages and characterizing features of the present invention will be clearly apparent in the following detailed description of the preferred embodiments when read in conjunction with the accompanying drawings.

BRIEF DESCRIPTION OF THE DRAWINGS

FIG. 21 is a fragmentary side elevational view of a connector assembly according to another embodiment of the present invention.

FIG. 22 is a fragmentary end elevational view thereof.

FIG. 23 is a plan view of the spacer plate in the connector of FIGS. 21 and 22.

DETAILED DESCRIPTION OF THE PREFERRED EMBODIMENTS

Figure 1:
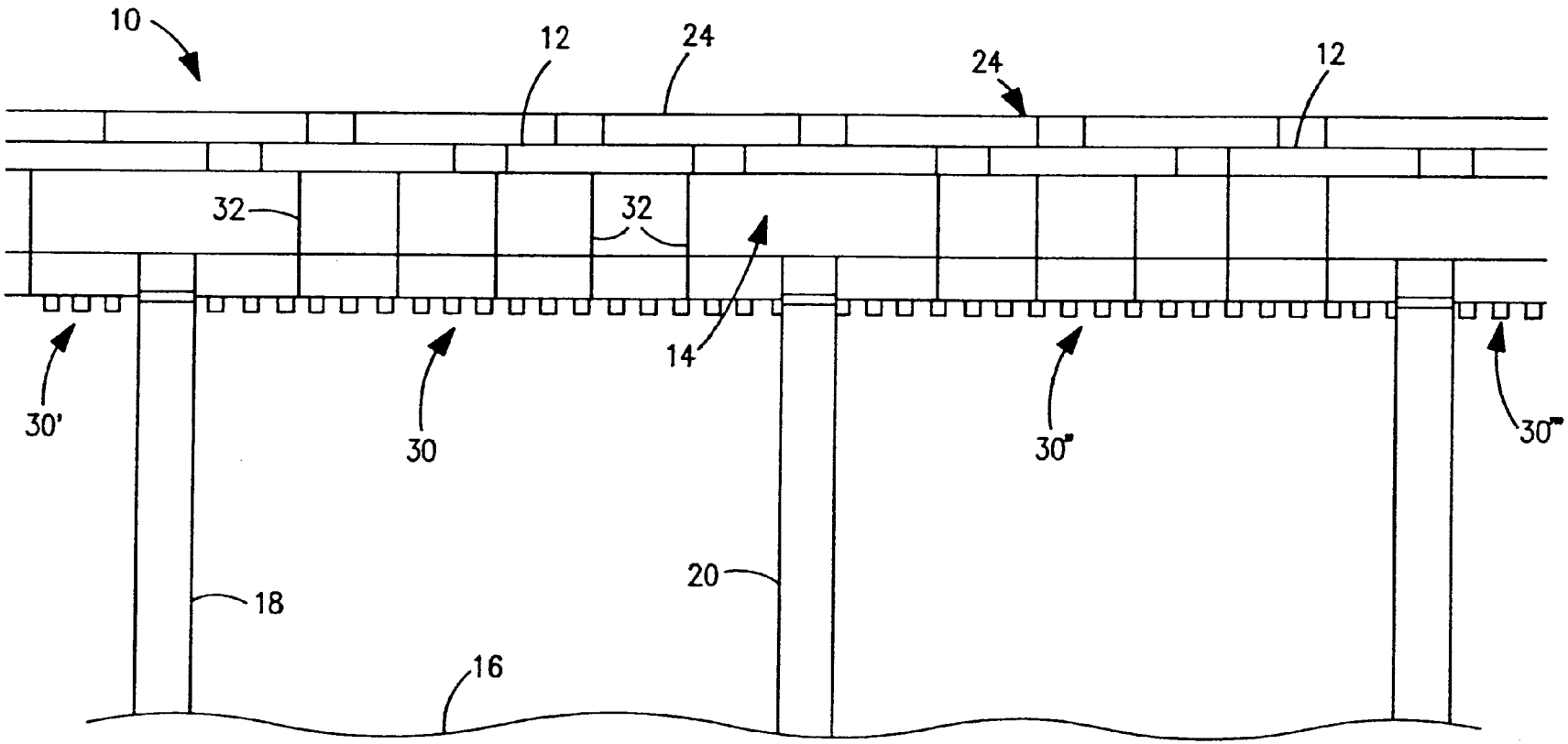
FIG. 1 is a fragmentary side elevational view, partly diagrammatic, of a bridge having a work platform according to the present invention installed thereon.

Referring first to FIG. 1, there is shown a portion of a bridge 10 including a deck or roadway 12 supported by structural steel 14 which, in turn, is supported above the ground 16 by concrete piers or pedestals at regular intervals along the length of the bridge. Three piers 18, 20 and 22 are shown on the bridge section of FIG. 1, although many such piers are included along the total length of an actual bridge. A railing 24 is shown extending along the length of bridge deck 12. The work platform 30 of the present invention in the situation illustrated herein is located below the bridge deck 12 and between the piers 18, 20 and is supported from the piers 18, 20 or the bridge structural steel 14. The platform 30, which will be described presently, includes a plurality of cables (not shown in FIG. 1) extending lengthwise of bridge 10 and supported at opposite ends by piers 18, 20 or by steel structure 14, and a plurality of flooring sections or panels supported by the cables, each extending transversely of the cables and also transversely of bridge 10, and the sections are in side-by-side relation along the length of bridge 10. Each flooring section is removably connected at spaced locations thereon to the cables. The platform can be supported additionally at spaced locations therealong by the bridge structural steel 14 by means of auxiliary support cables, some of which are designated 32 in FIG. 1. While the present description is directed to the single platform 30, a plurality of platforms, three of which are designated 30', 30" and 30''' in FIG. 1 can be provided along the length of bridge 10.

While the work platform of the present invention is described herein for use in connection with a bridge, it should be understood that it may also be provided as scaffolding in connection with buildings and other structures for such purposes as maintenance, repair, and cleaning thereof. Therefore, for the purposes of this specification and the claims, the term "structure," unless another meaning is specified or the context indicates otherwise, shall mean "bridge, building, or other construction suitable for application of scaffolding."

Figure 2:
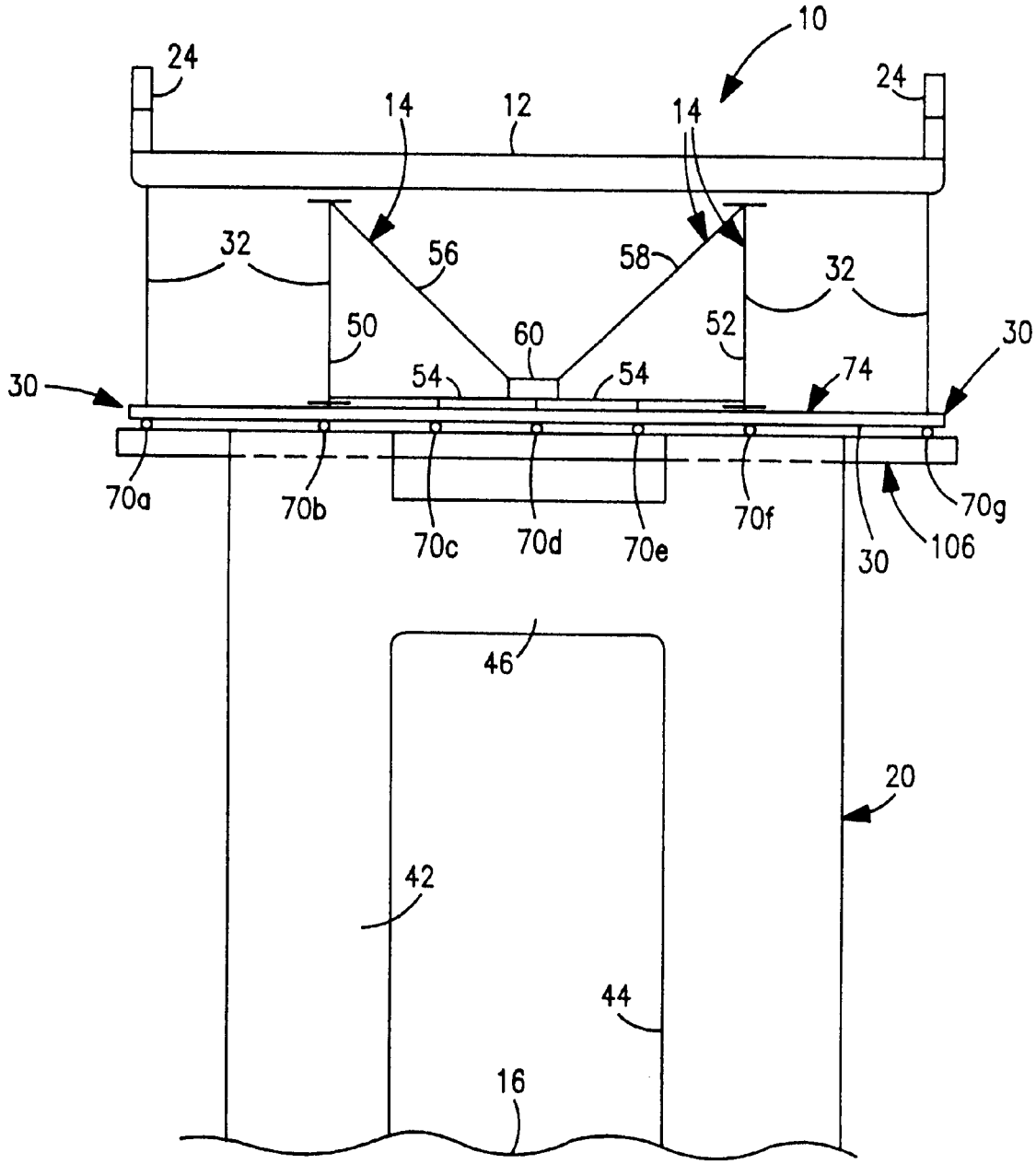
FIG. 2 is a fragmentary cross-sectional view, partly diagrammatic of the work platform of FIG. 1.

Referring now to FIG. 2, there is shown one of the bridge piers, for example pier 20, which has a pair of vertical pedestals or columns 42 and 44 joined near the upper ends by a central body 46. The bridge structural steel 14 includes sidewalls 50 and 52 which rest on the tops of pedestals 42 and 44 respectively and which are connected at spaced locations along the length of bridge 10 by a series of assemblies each including a horizontal frame member 54 and inclined frame members 56 and 58 joined at the lower ends to a central plate 60 fixed to frame member 54 and joined at the upper ends to the corresponding sidewalls 50 and 52. Thus, the bridge roadway or deck 12 is supported by the combination of the piers and steel walls 50, 52 and frame assemblies in a known manner. In addition, the walls 50, 52 and frame assemblies provide the surfaces which must be periodically cleaned, such as by abrasive blasting or the like, and painted.

As shown in FIG. 2, the supporting cables 70 of the platform 30 of the present invention extend longitudinally of bridge 10 between the piers and are spaced apart substantially equally in a transverse direction relative to bridge 10. Thus, cables 70 are disposed in a plane substantially parallel to the plane of bridge deck 12. By way of example, in an illustrative bridge having a width of about 32 feet and a distance between piers of about 140 feet, seven steel cables 70*a*–70*g* each one-half inch in diameter are provided. The cables 70 are secured to a structure of bridge 10 so that the plane of the cables is at a desired distance below the portion of bridge 10 upon which work is to be performed. In the platform illustrated in FIGS. 1 to 3, cables 70*a* to 70*g* are attached at opposite ends to piers 18 and 20 by compression clamp assemblies which will be described. The platform flooring, generally designated 74 in FIG. 2, rests on and is supported by cables 70*a* to 70*g*. Flooring 74 comprises a plurality of sections or panels each releasably connected to corresponding cables 70 in a manner which will be described in detail presently.

Figure 3:
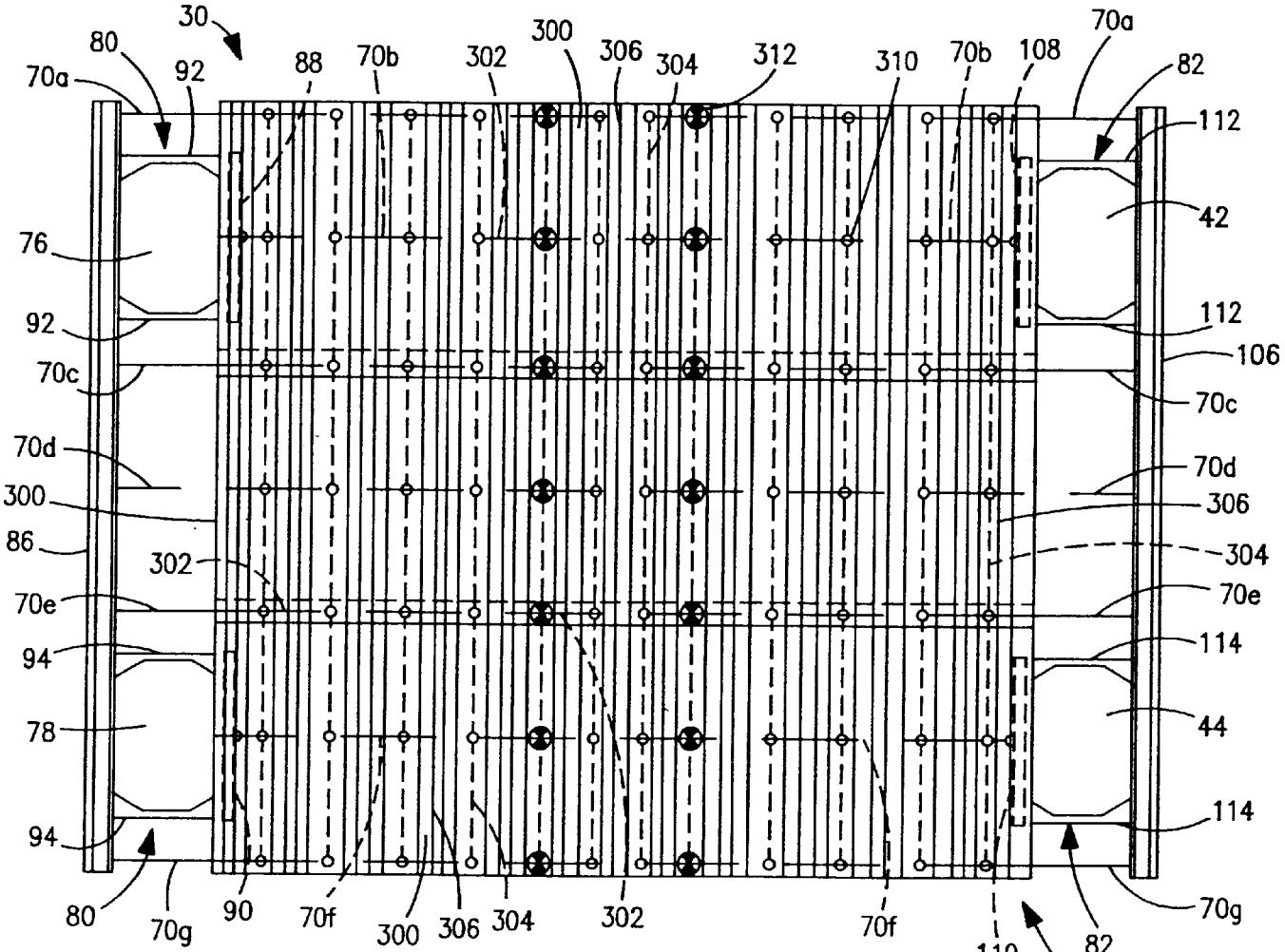
FIG. 3 is a plan view of the work platform of FIG. 1.

The plan view of FIG. 3 illustrates a form of clamping assemblies for attaching opposite ends of cables 70 to the bridge piers 18 and 20. The clamping assemblies shown in FIGS. 1 to 3 are the subject of the above-referenced U.S. Pat. No. 5,730,248 and are described herein briefly for the purpose of providing a proper background for the detailed description of the cable connector assemblies of this invention which will follow. Another embodiment of the connector assembly uses a wedge to connect the two parts together so as to eliminate the difficulty of removing rusty nuts to disconnect the parts. The pedestals 42 and 44 of pier 20 are shown in FIG. 3. Pier 18 likewise has two pedestals designated 76 and 78 in FIG. 3. A first compression clamping assembly generally designated 80 secures all of the cables 70 at one end thereof, i.e. the left-hand end as viewed in FIG. 3, to pedestals 76 and 78 of pier 20. A second compression clamping assembly generally designated 82 and identical to assembly 80 secures all of the cables 70 at the opposite end thereof, i.e. the right-hand end as viewed in FIG. 3, to pedestals 42 and 44 of pier 20. Clamping assembly 80 comprises a first member or I-beam 86 extending transversely of bridge 10 and contacting both pedestals 76 and 78 on one side thereof and second and third members or I-beams 88 and 90 also extending transversely but each contacting only a corresponding one of the pedestals 76 and 78 and on the opposite side thereof. Members 86 and 88 are clamped to pedestal 76 by a plurality of threaded connecting rods 92 which are tightened to provide the required amount of compression force. Similarly, members 86 and 90 are clamped to pedestal 78 by a plurality of threaded connecting rods 94 which are tightened to provide the required amount of compression force. Thus, I-beam 86 contacts the left-hand surfaces of pedestals 76 and 78 as viewed in FIG. 3 and I-beams 88 and 90 contact the right-hand surfaces of pedestals 76 and 78 respectively as viewed in FIG. 3. Cables 70*b* and 70*f* are connected at one end to I-beams 88 and 90 respectively, and the remaining cables 70*a*, 70*c* to 70*e*, and 70*g* are connected to I-beam 86. The clamping assembly and the manner of connecting cables 70 thereto will be described in further detail presently.

In a similar manner, clamping assembly 82 comprises a first member or I-beam 106 extending transversely of bridge 10 and contacting both pedestals 42 and 44 on one side thereof and second and third members or I-beams 108 and 110 also extending transversely but each contacting only a corresponding one of the pedestals 42 and 44 and on the opposite side thereof. Members 106 and 108 are clamped to pedestal 42 by a plurality of threaded connecting rods 112 which are tightened to provide the required amount of compression force. Similarly, members 106 and 110 are clamped to pedestal 44 by a plurality of threaded connecting rods 114 which are tightened to provide the required amount of compression force. Thus, I-beam 106 contacts the right-hand surfaces of pedestals 42 and 44 as viewed in FIG. 3, and I-beams 108 and 110 contact the left-hand surfaces of pedestals 42 and 44 as viewed in FIG. 3. Cables 70*b* and 70*f* are connected at the ends to I-beams 108 and 110 respectively, and the remaining cables 70*a*, 70*c* to 70*e*, and 70*g* are connected to I-beams 106.

Figure 4:
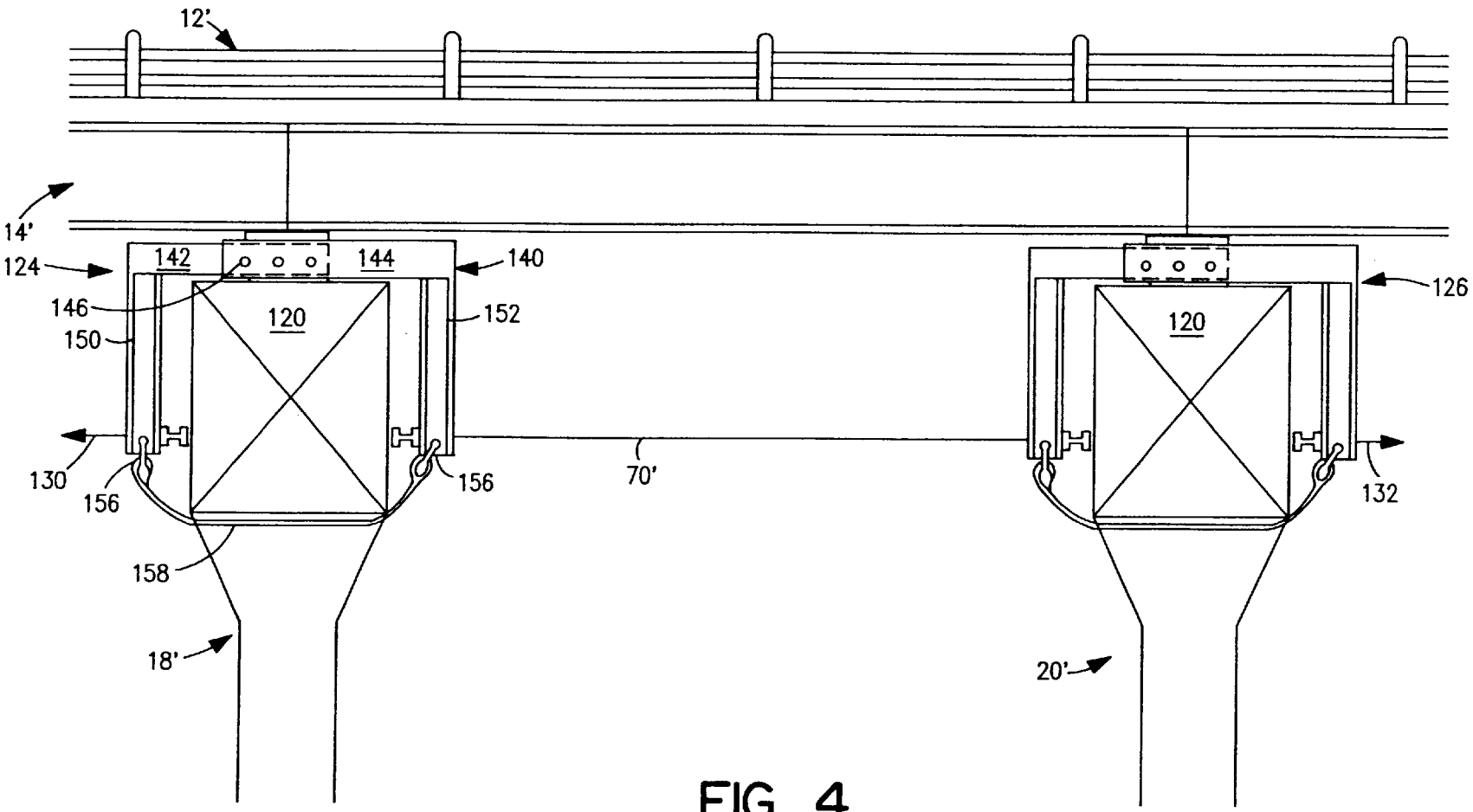
FIG. 4 a fragmentary side elevational view showing a pair of clamp assemblies according to one embodiment of the present invention for use with the work platform of FIGS. 1 to 3.

Referring now to FIGS. 4 to 8, there is shown a clamp assembly according to the present invention for securing cables 70 of platform 30, exclusively to the piers of a bridge. Depending upon the structure of a particular bridge and/or the work to be performed on it, there are situations where only the concrete piers and none of the bridge steel structure 14 can be utilized to support platform 30. As shown in FIG. 4, a pair of piers 18' and 201 support the bridge structural steel 14, below bridge deck 121, and piers 18' and 201 have upper cap portions 118 and 120 respectively. A clamp assembly generally designated 124 is secured to pier cap 118 and an identical clamp assembly, generally designated 126, is secured to pier cap 120. The cables, one of which is designated 70' in FIG. 4, for supporting platform 301 are secured at opposite ends to clamp assemblies 124 and 126. A corresponding plurality of cables, one of which is designated 130, can be connected between clamp assembly 124 and an identical clamp assembly (not shown) on a neighboring pier (not shown) for supporting another platform (not shown) in an identical manner. Similarly, another corresponding plurality of cables, one of which is designated 132, can be connected between clamp assembly 126 and an identical clamp assembly (not shown) on a neighboring pier (not shown) for supporting another platform (not shown) in an identical manner. Clamp assemblies 124 and 126 identical, and for convenience only clamp assembly 124 will be described in detail in connection with FIGS. 4 to 8.

Figure 5:
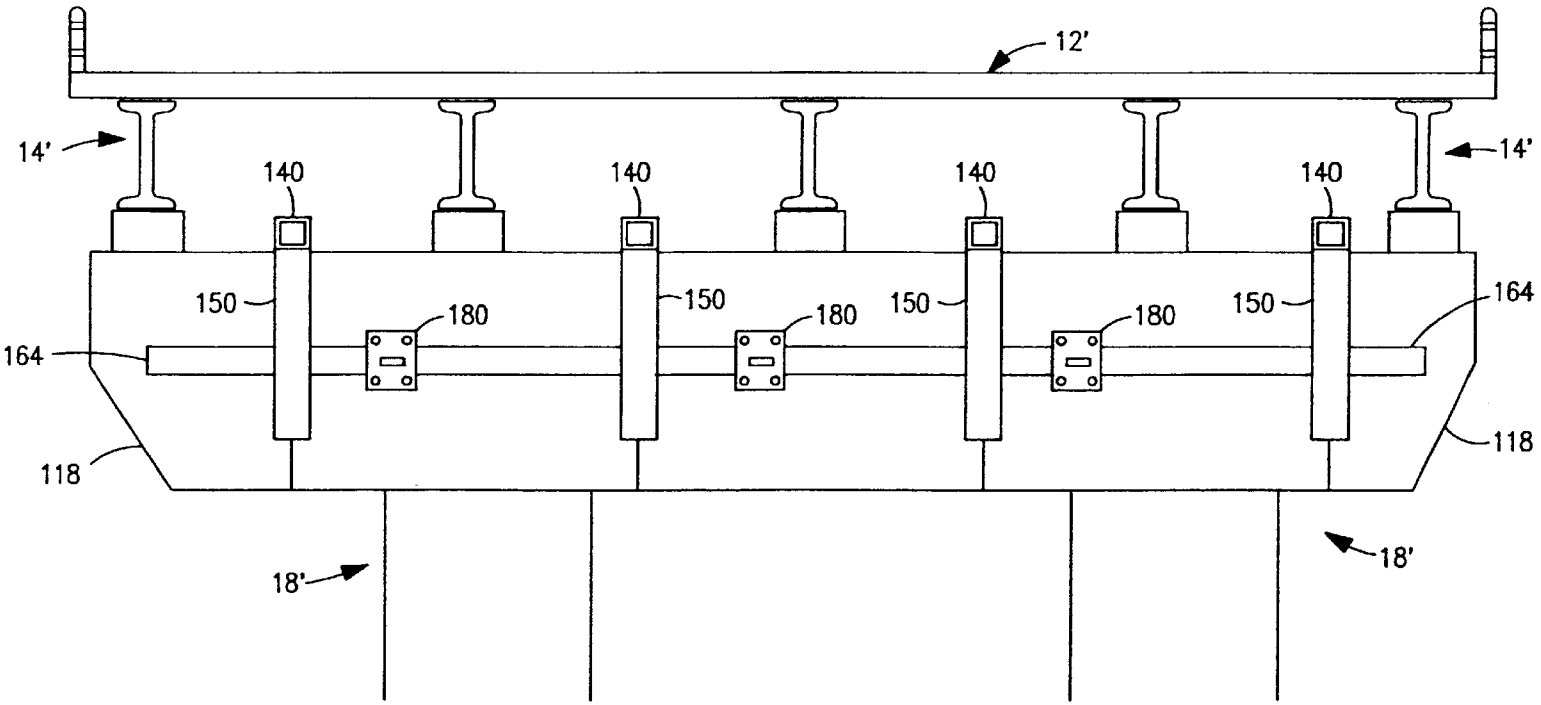
FIG. 5 is a fragmentary end elevational view of one of the clamp assemblies of FIG. 4.

Clamp assembly 124 includes a plurality of pier brackets, each generally designated 140, secured to upper cap portion 118 of pier 181 at laterally spaced locations therealong, as shown in FIG. 5. By way of example, in an illustrative work platform, pier brackets 140 are spaced apart about 7 to 8 feet. Each pier bracket 140 comprises a pair of telescoping or relatively reciprocal hollow steel members 142 and 144 which fit relatively snugly but movably one within the other. The members 142 and 144 rest on the top surface of pier cap portion 118 and, after being adjusted to the width of pier cap portion 118, are locked against any relative movement by pins or bolts 146, as shown in FIG. 4. A pair of light duty I-beams or posts 150 and 152 depend from the outer ends of members 142 and 144 respectively and are fixed thereto such as by welding. Each I beam 150 and 152 and its corresponding member 142 and 144 respectively define substantially a right angle therebetween. The lower end of each I-beam 150 and 152 is provided with an opening to receive a hook 156 or the like to enable a cable 158 to be connected to the lower ends of I-beams 150 and 152 and to be tightened against the bottom of pier cap portion 118 to prevent tipping or similar movement of each pier bracket 140.

The plurality of pier brackets 140 support a horizontally disposed beam 164 to which the plurality of platform supporting cables are secured at the ends thereof and which is vertically adjustable in the following manner. By way of example, in an illustrative work platform, beam 164 is a W6×16 beam that extends for the entire width of the work platform. Beam 164 is supported in a vertically adjustable manner on each pier bracket depending beam or part 150 by the arrangement shown in FIGS. 7 and 8. Beam 164 is supported by a plurality of angle brackets 170, one for each part 150, which in turn is held in place by a pair of bolt 172 and nut 174 fasteners on each side of post 142 which engage a plate 178 on the opposite face of post 142. Thus, by means of the arrangement shown in FIGS. 7 and 8, beam 164 is supported on posts 142 and can be raised or lowered simply by changing the location of each angle 170 and plate 178 combination on the corresponding part 142.

Figure 6:
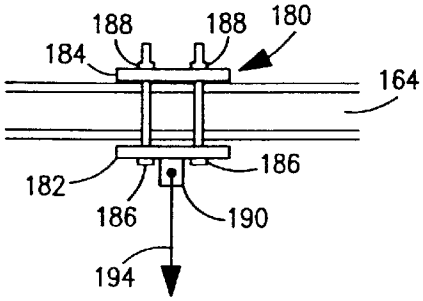
FIG. 6 is an enlarged fragmentary plan view of the means for providing horizontal adjustment of the cable locations in the assemblies of FIGS. 4 and 5.
Figure 7:
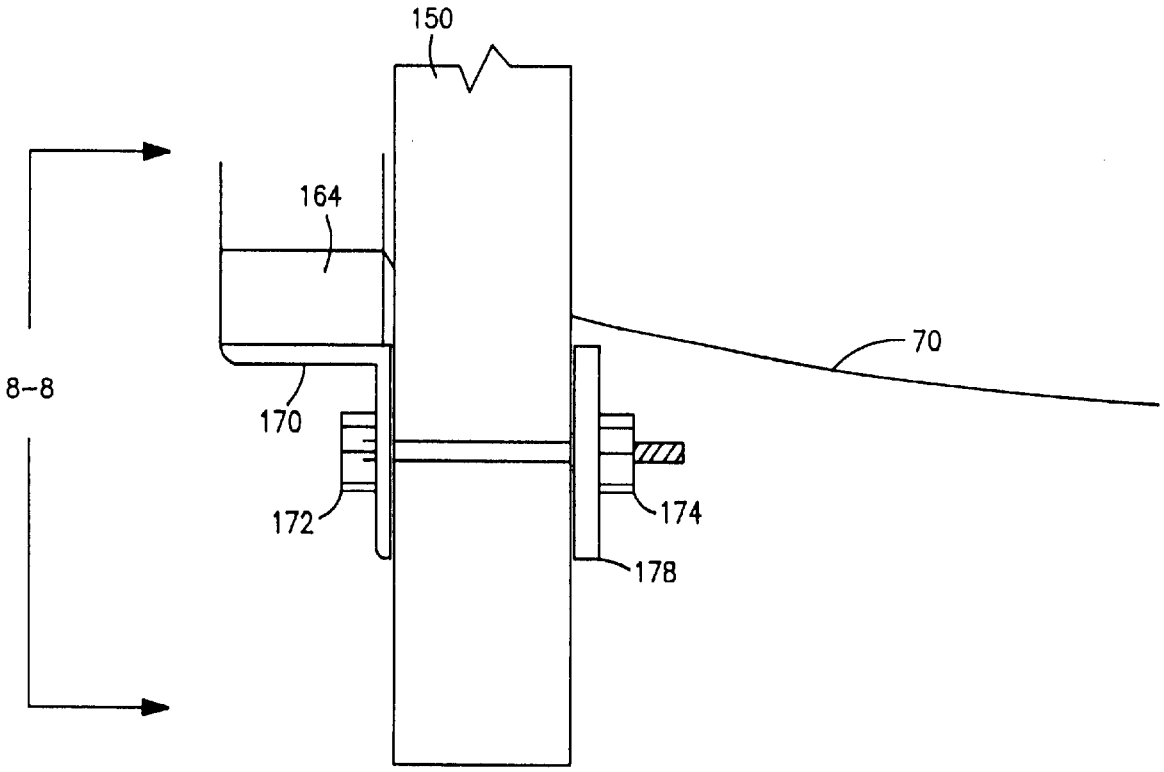
FIG. 7 is an enlarged fragmentary elevational view of the means for providing vertical adjustment of the cable locations in the assemblies of FIGS. 4 and 5.
Figure 8:
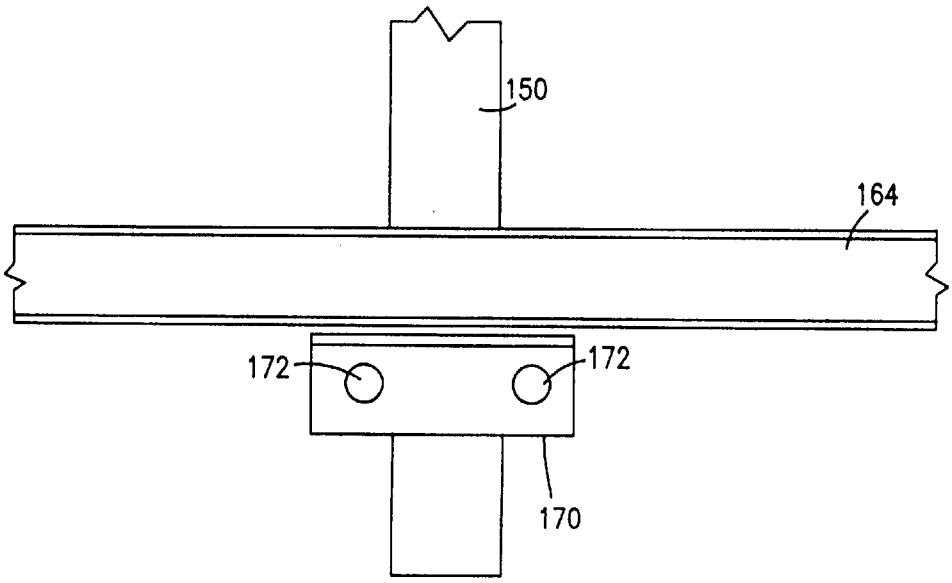
FIG. 8 is a fragmentary elevational view taken along line 8—8 in FIG. 7.

The work platform supporting cables are connected at ends thereof to cable connector assemblies 180, one assembly for each cable, which are mounted on beam 164. The locations of connector assemblies 180 on beam 164 are adjustable in a horizontal direction so that the spacing between adjacent cables can be varied. As shown in FIG. 6, each connector assembly 180 includes a pair of plates 182 and 184 clamped on beam 164 by a plurality of bolt 186 and nut 188 type fasteners. A shackle plate 190 is provided as one of the plates 182 for connection to one end of the cable, designated 194 in FIG. 6.

Thus, the clamp assembly shown in FIGS. 4 to 8 secures the cables of the work platform exclusively to the piers of a bridge. The horizontal spacing between each of the cables is individually adjustable. The vertical location of all of the cables is adjustable simultaneously. In other words, the distance between the plane in which the cables lie and the plane of the bridge deck is adjustable. As a result, the vertical location of the platform flooring is adjustable relative to the location of the bridge deck and steel structure to accommodate various types of maintenance and repair operations on the bridge.

Figure 9:
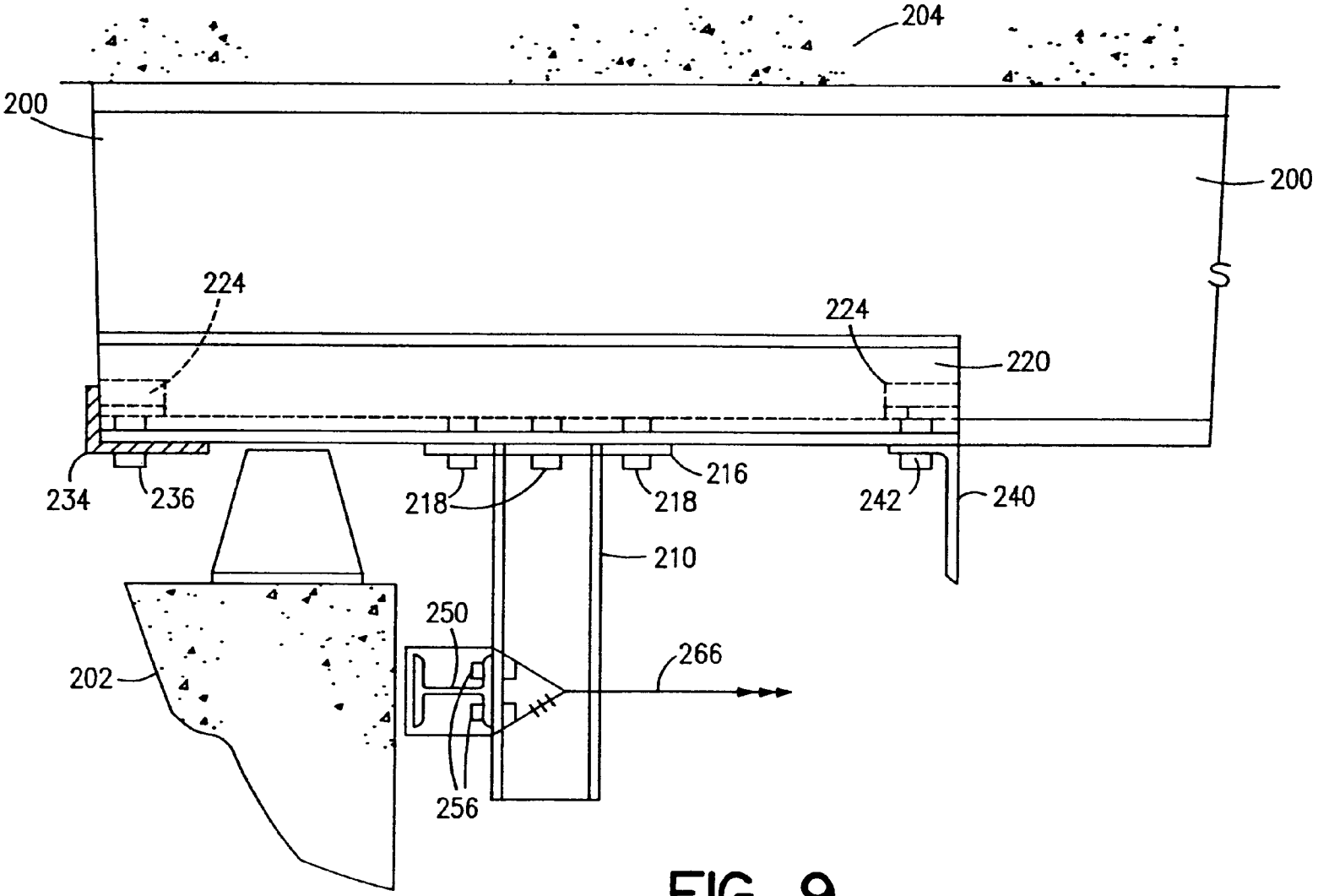
FIG. 9 is a fragmentary side elevational view showing a clamp assembly according to another embodiment of the present invention for use with the work platform of FIGS. 1 to 3.
Figure 10:
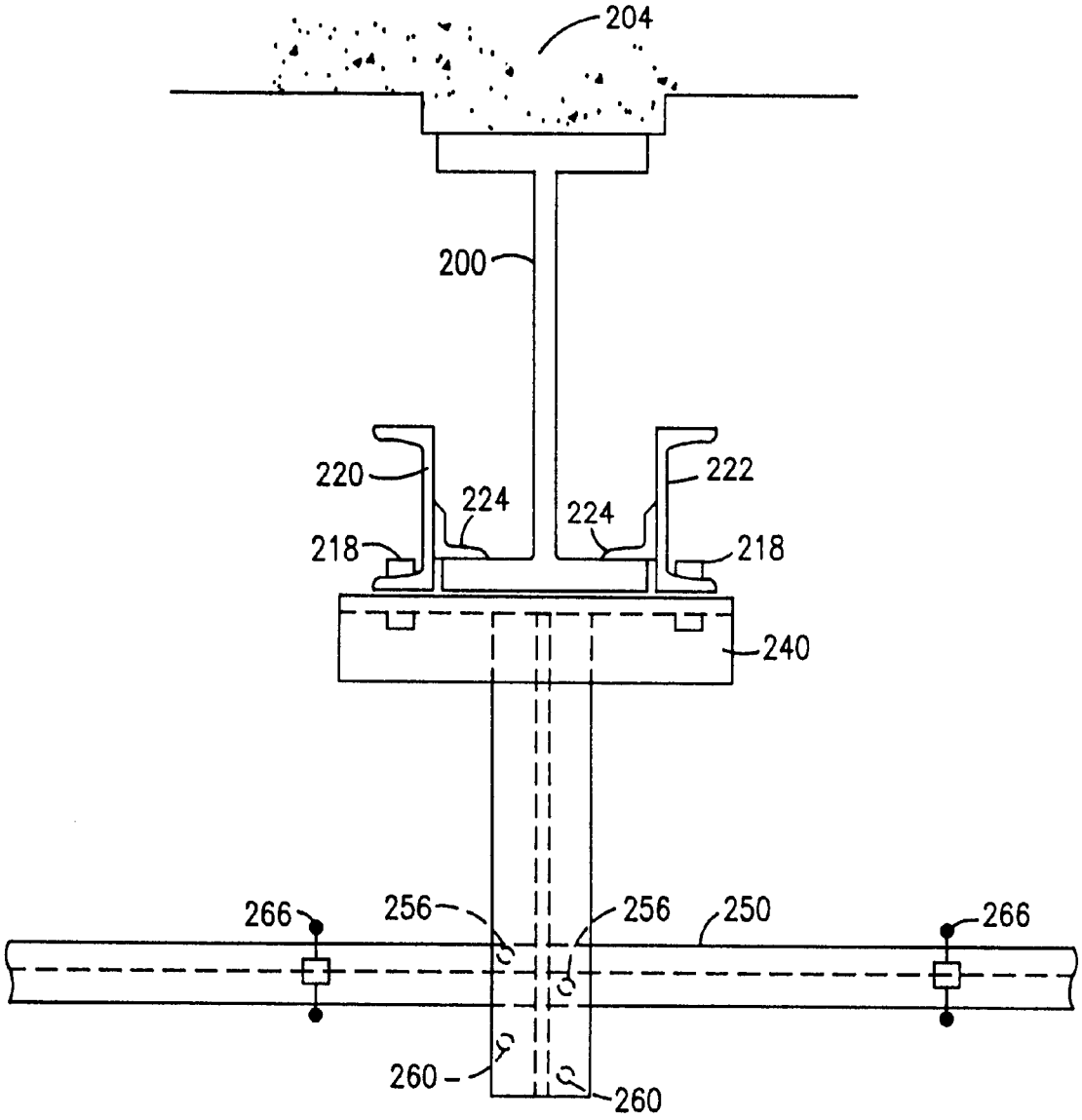
FIG. 10 is a fragmentary end elevational view of the clamp assembly of FIG. 9.

FIGS. 9 and 10 show a clamp assembly according to the present invention for securing cables 70 of platform 30 exclusively to the bridge steel structure. Depending upon the structure of a particular bridge and/or the work to be performed on it, there are situations where only the bridge steel structure and none of the bridge concrete piers or abutments can be used to support platform 30. As shown in FIG. 9, a bridge girder or stringer 200 is supported at one end by a bridge concrete abutment or pier 202, and stringer 200, in turn, supports the bridge deck 204. The opposite end of stringer 200 is supported on a similar pier or abutment (not shown) and a plurality of such girders are provided, extending longitudinally of the bridge and spaced apart laterally of the bridge at appropriate distances.

The clamp assembly according to this embodiment of the present invention comprises a generally vertically disposed post 210 which is mounted at one end to stringer 200 and depends therefrom. While for convenience in illustration only one post 210 is shown in FIGS. 9 and 10, the clamp assembly includes a plurality of such posts, one for each girder or stringer of the bridge on which the work platform is installed. Post 210 is mounted at one end thereof to stringer 200 in the following manner. A plate 216 is welded on the end of post 210 and is secured by bolt and nut type fasteners 218 to a pair of channel members 220 and 222 which extend longitudinally along and are mounted to opposite sides of stringer 200. In particular, each channel member 220 and 222 has a pair of angle members, each designated 224 fixed thereto such as by welding and located at opposite ends thereof. One flange of each angle member 224 is welded to the web of the corresponding channel member, as shown in FIG. 10, and the other flange of each-angle member 224 rests on and is supported by the lower horizontal flange of girder 200. Another angle member 234 is provided at the end of girder 200 adjacent pier 202 and fixed to the flanges of girder 200 and channel members 220 and 222 by bolt and nut type fasteners 236 to prevent movement longitudinal movement of channels 220 and 222 to the left as viewed in FIG. 9. At the opposite ends of channels 220 and 222 an angle member 240 is fixed to the flanges of girder 200 and channels 220 and 222 by bolt and nut fasteners 242 to support the channels 220 and 222 in place.

The clamp assembly further comprises a generally horizontally disposed beam 250 connected to post 210 for receiving the ends of the cables which support the platform flooring. Beam 250 is connected at a selected vertical location to post 210 by bolt and nut type fasteners designated 256. Vertical adjustment of the location of beam 250 on post 210 is provided by a series of openings 260 on the flanges of post 210 as shown in FIG. 10. As previously mentioned, a plurality of posts like post 210 are provided, one depending from ea6h girder or stringer of a bridge on which the work platform is installed, and beam 250 is connected to each of the posts in a manner identical to the connection to post 210 shown in FIGS. 9 and 10. Alternatively, a series of such beams can be provided, extending over the width of the platform and connected to the posts. Cables such as those designated 266 in FIGS. 9 and 10 are secured to beam 250 in a suitable manner.

By way of example, in an illustrative bridge platform, post 210 is a W10×33 I-beam having a length of about 4.0 feet, plate 216 has a thickness of about ½inch, each channel member 220 and 222 is a C10×13 channel having a length of about 5.0 feet, each angle member 224 has flanges about 3.0 inches long and about 3.0 inches wide and about ½inch thick, the flanges of angle member 234 are about 4.0 inch long and about 8.0 inch long respectively and about 1.2 inch thick, angle member 240 has the same dimensions as angle member 234, beam 250 is a W8×18 I-beam, cables 266 have a diameter of about ⅝inch, and the bolt and nut fasteners 218, 236, and 242 include ¾inch bolts.

Figure 11:
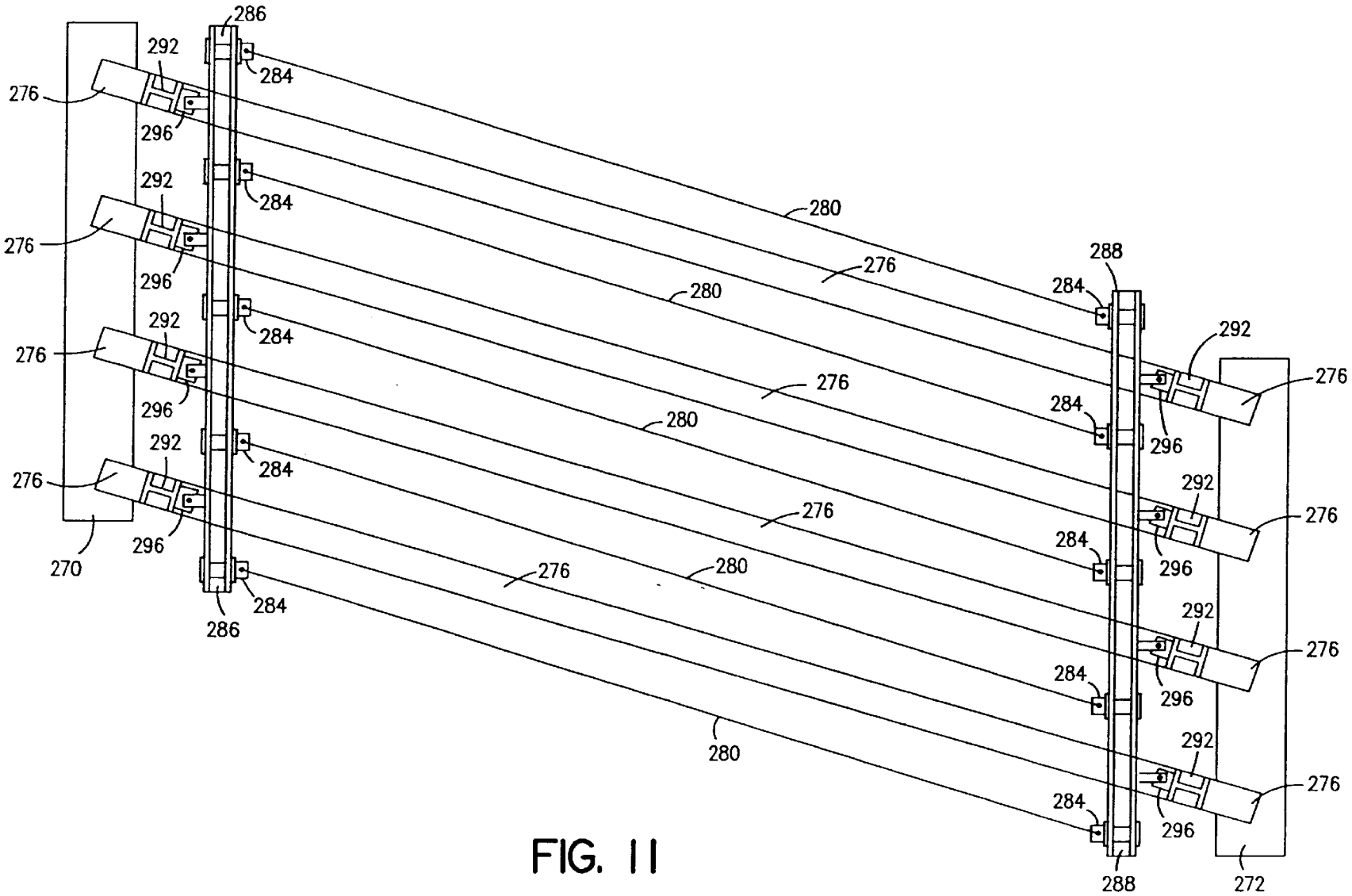
FIG. 11 is a plan view showing a clamp assembly according to another embodiment of the present invention for use with the work platform of FIGS. 1 to 3.
Figure 13:
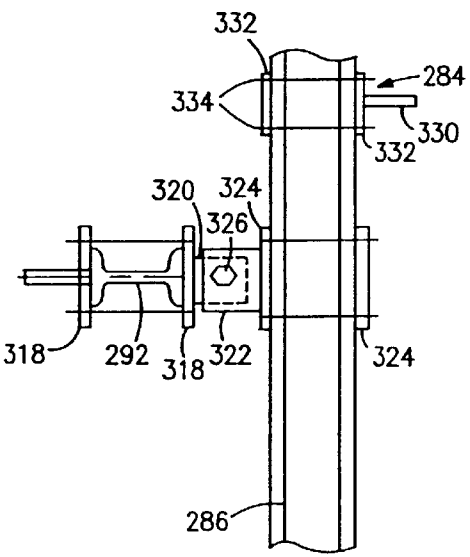
FIG. 13 is a fragmentary plan view of the assembly of FIG. 12.
Figure 12:
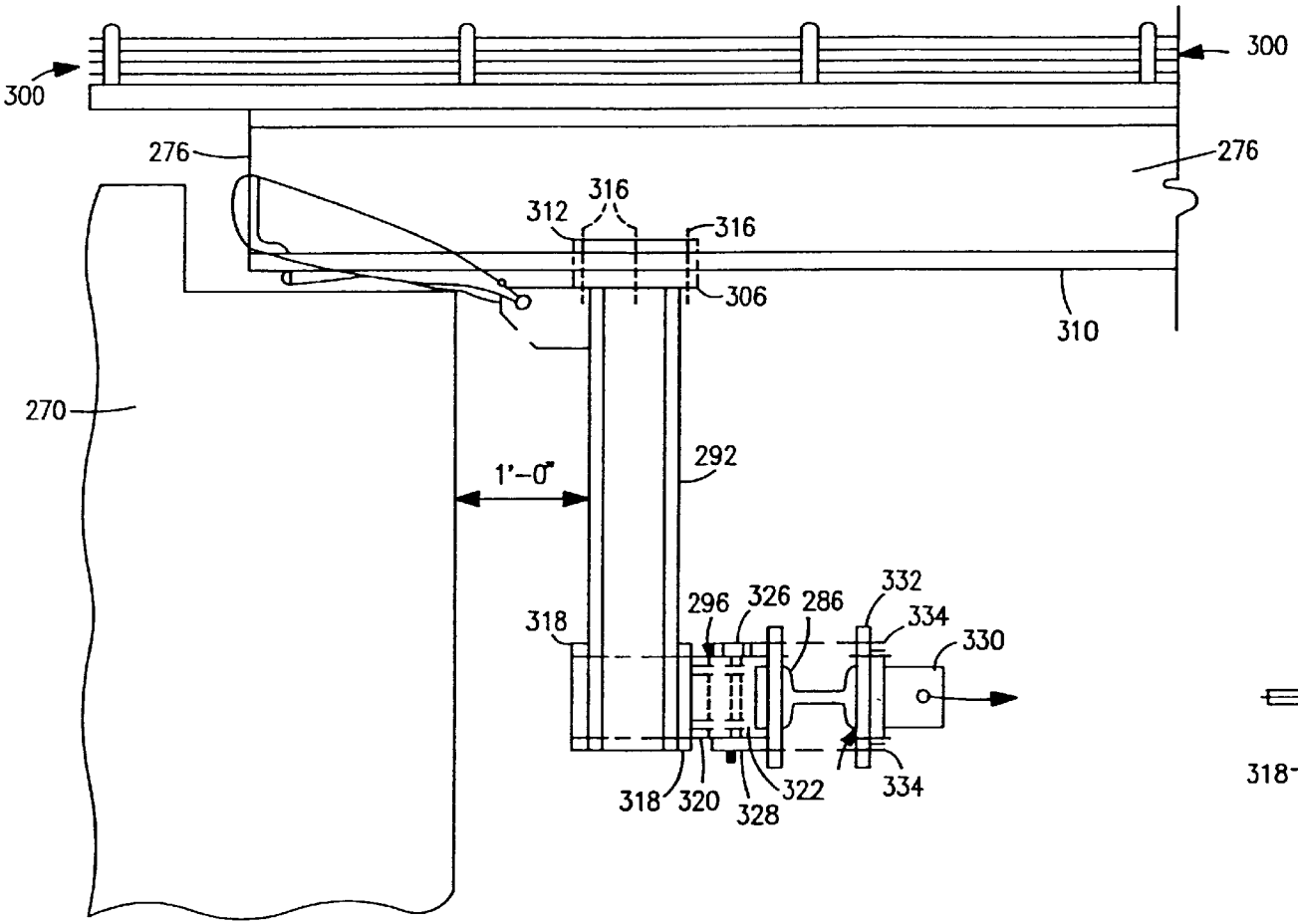
FIG. 12 is a fragmentary side elevational view of a portion of the clamp assembly of FIG. 11.

FIGS. 11 to 13 show a clamp assembly for securing cables 70 of work platform 30 exclusively to the bridge steel structure and having the added capability for installation on bridges with skewed or angled sections. A skewed or angled bridge section is illustrated in the plan view of FIG. 11 wherein a pair of offset bridge piers or abutments 270 and 272 support a series of girders or stringers each designated 276 in a skewed or angled arrangement. A series of cables 280, similar to cables 70 of platform 30, which support the work platform of the present invention are connected at opposite ends thereof to cable connector assemblies 284 which, in turn, are mounted on horizontally disposed beams 286 and 288 located near corresponding ones of the bridge piers or abutments 270 and 272 respectively as viewed in FIG. 11. Beams 286 and 288, in turn, are supported by an arrangement including a plurality of vertically disposed post members 292 which are mounted at the upper ends of corresponding ones of the girders 276 in a manner which will be described. Post members 292 are connected to corresponding ones of the beams 286 and 288 by swivel connector assemblies 296 which will be described in detail presently.

FIG. 12 shows in further detail the arrangement including one of the post members 292 for supporting beam 286. Abutment 270 supports girder 276 which along with the other girders and abutment 272 (shown in FIG. 11) supports bridge deck 300. A plate 306 is welded to the upper end of post member 292 and is of sufficient size to extend across and outwardly of the lower flange 310 of girder 276. A pair of plates, one of which is designated 312 in FIG. 12, is provided and placed on the top surfaces of girder flange 310. The plates are of sufficient size to extend outwardly beyond the girder flange 310. Then the combination of the larger plate 306 and pair of smaller plates is fastened together and against girder flang 310 by a series of bolt and nut type fasteners 316 on both sides of girder flange 310, thus clamping the upper end of post member 292 to girder flange 310. A swivel plate assembly 296 then is clamped by plates 318 bolted to post member 292 at a selected vertical location thereon. Post 292 is provided with a series of openings (not shown) to receive bolts at various vertical locations to provide vertical adjustment of the location of assembly 296. As shown in FIGS. 12 and 13, each swivel plate assembly comprises a first part 320 clamped and bolted to post member 292, a second part 322 secured to beam 286 by a clamp assembly 324, and a pivotal connection between parts 320 and 322 provided by a headed bolt or pin 326 held therein by a nut 328 threaded thereon. Part 322 is a hollow member having aligned apertures to receive pin 326, and part 320 is a plate with a central aperture to receive pin 326 and which is received in part 322 with room for pivotal movement therein. FIGS. 12 and 13 also show in further detail one of the cable connector assemblies 284 comprising an apertured plate 330 welded to a clamp assembly 332 fixed to beam 286 by bolt and nut type fasteners 334. The construction shown in FIGS. 12 and 13 is the same for each of the posts 292, cable connector assemblies 284, and swivel connector assemblies 296 in the arrangement of FIG. 11.

Thus, the swivel connectors 296 in the arrangement of FIGS. 11 to 13 accommodate installation of the work platform of the present invention on angled or skewed bridge sections. By way of example, in an illustrative work platform, each post member 292 can be a W8×15 small I-beam or square tube. Each post 292 can be tied back to the bridge bearing by ⅝inch cable for additional security if desired.

Figure 14:
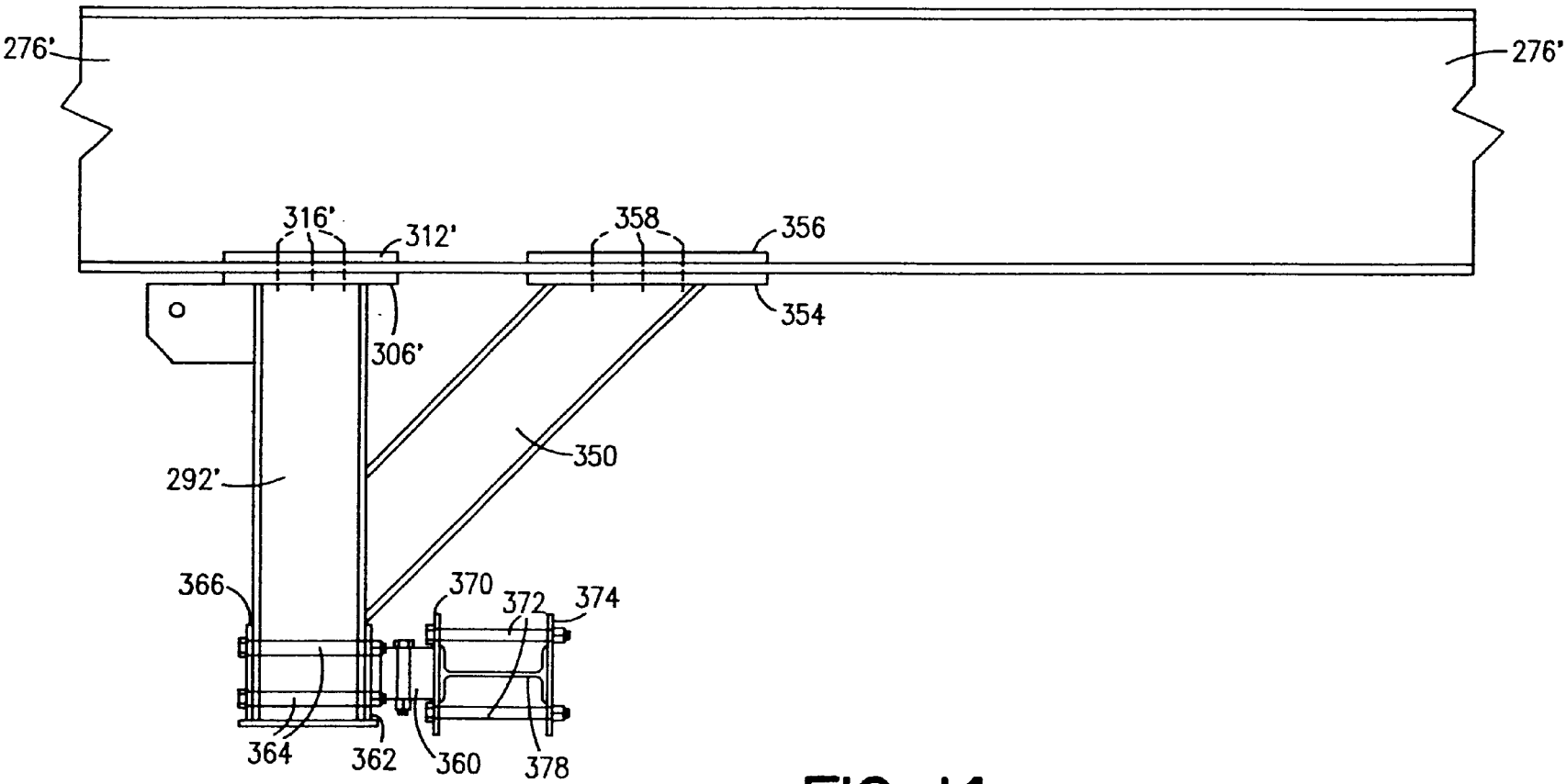
FIG. 14 is a fragmentary side elevational view of an alternative form of the clamp assembly of FIGS. 11 and 12.

FIG. 14 shows an alternative form of post construction for use in an arrangement like that of FIGS. 11–13. Post 292' is similar to post 292 in the previous arrangement and is fastened to girder 276' by a similar arrangement of large plate 306', small plates 312', and fasteners 316'. A reinforcing member 350 is fixed at one end to post 292' by welding or bolt and nut type fasteners (not shown) and extends upwardly at an angle whereupon it is fastened to the lower flange of girder 276' by a similar arrangement of large plate 354 welded to the end of member 350 and a pair of small plates 356 fastened in a clamp-like arrangement to the girder flange by bolt and nut type fasteners 358. A swivel bracket 360 is welded to a plate 362 which is joined by bolt and nut type fasteners 364 to another plate 366 such that the two plates 362 and 366 clamp on post 292' to secure swivel bracket 360 thereto. The clamping arrangement allows vertical adjustment of the location on post 292'. By way of example, in an illustrative arrangement, swivel bracket 360 is like the assembly 296 in FIGS. 12 and 13 consists of a hollow steel member 4"×4"×¼"×4" welded onto a 7"×9"×½" plate and two 4"×4"×½" plates welded to another 7"×9"×½" plate and connected by a ⅛"×7" long bolt secured with a nut. Swivel bracket 360 also is welded to a plate 370 which is joined by bolt and nut type fasteners 372 to another plate 374 such that the two plates 370 and 374 clamp on a horizontally disposed beam 378 to secure swivel bracket thereto. Beam 378 extends for the entire width of the work platform and has the supporting cables (not shown) secured thereto in a manner similar to the preceding arrangements. By way of example, in an illustrative work platform, post 292' is a W8×18 beam, and beam 378 is a W8×15 beam. An apertured plate 380 can be fixed such as by welding to post 292' for connection of a reinforcing cable to the bridge abutment or pier, if desired for added security.

Figure 26:
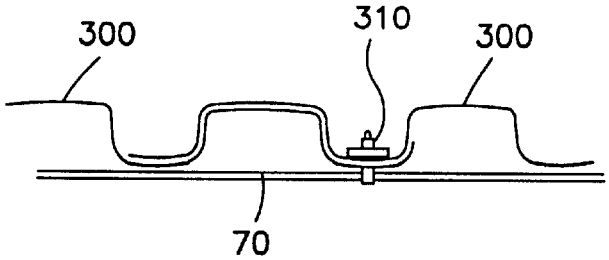
FIG. 26 is a partial schematic side edge view of the work platform of FIG. 1.

Referring again to FIG. 3, the platform flooring 74 comprises a plurality of elongated rectangular panels each designated 300 which are arranged in end-to-end overlapping relation transversely of bridge 10 and cables 70, as indicated by the broken lines 302 in FIG. 3, and which panels 300 are arranged in side-by-side overlapping relation longitudinally of bridge 10 and cables 70, as indicated by the broken lines 304 in FIG. 3 and as also shown in FIG. 26. Panels 300 are corrugated decking panels with the corrugations extending transversely of cables 70 as indicated at 306 in FIG. 3 and as also shown in FIG. 26. Having corrugations 306 extending transversely of cables 70 maximizes the rigidity and strength of flooring 74 and prevents any buckling of the panels 300. Each of the platform flooring sections or panels 300 is releasably connected at spaced locations to the supporting cables 70 on which it rests. This is provided by connector assemblies generally indicated at 310 in FIG. 3 and which will be described in detail presently. As a result, individual flooring sections or panels 300 can be removed to provide access through the flooring in emergency situations. For example, if a worker becomes seriously ill or injured, one or more flooring sections 300 can be quickly and easily removed thereby allowing the worker to be lowered safely to the ground below. In addition, collected debris remains in the corrugations of the removed panel and is not lost from containment within the area of the platform. With the panels 300 overlapping, they may be attached together and to the respective cable 70 at their overlapping portions, as shown in FIG. 26, to provide a more secure structure.

Some of the connector assemblies, i.e., those designated 312 in FIG. 3, also have the capability of an additional or auxiliary connection to the bridge structural steel 14 and will be described in detail presently.

Each panel 300 has a pair of side edges which are joined by a pair of end edges. Corrugations 306 extend longitudinally along each panel 300 and substantially parallel to side edges thereof. The corrugations 306 of all the panels 300 in flooring 74 extend transversely of cables 70 so as to provide the required strength and rigidity of the platform 30.

Each of the panels 300 comprising flooring 74 includes a plurality of openings extending therethrough for making connection to cables 70. The number and location of openings will depend upon the size of panels 300 and the distance between cables. Each panel 300 includes a first pair of openings located near one end and a second pair of openings located near the opposite end. Each of the openings is elongated and disposed with the longitudinal axis thereof substantially parallel to corrugation 306 and thus transversely of cables 70. The openings in the panels 300 enable the connector assemblies 310 and 312 to contact or engage both the cables 70 and panels 300 in a manner releasably connecting the panels to the cables.

Figure 15:
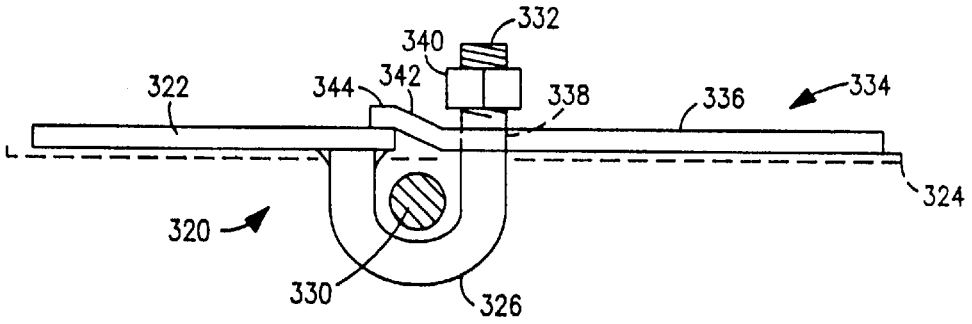
FIG. 15 is a fragmentary side elevational view of a connector assembly according to one embodiment of the present invention.
Figure 16:
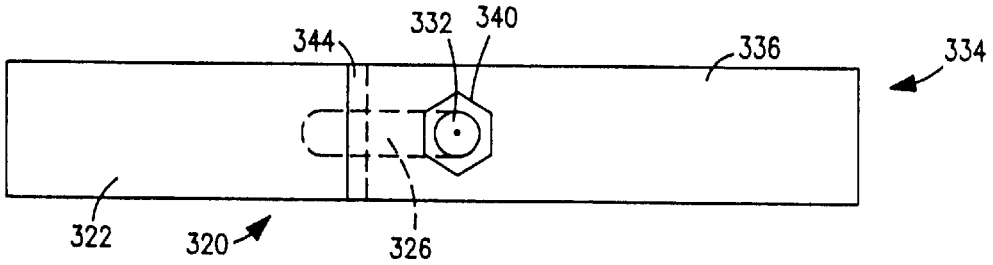
FIG. 16 is a plan view thereof.
Figure 17:
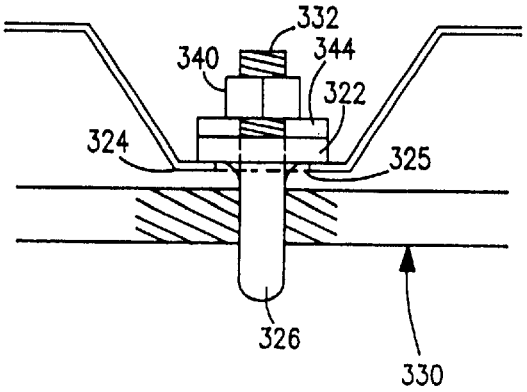
FIG. 17 is a fragmentary end elevational view thereof.

One form of connector assembly according to the present invention is shown in FIGS. 15 to 17 and includes a first part 320 in the form of a rectangular plate 322 which engages the upper surface of the platform flooring, indicated at 324 in FIG. 15, and a substantially U-shaped hook formation 326 extending from body 322 for engaging one of the cables, designated 330 in FIG. 15, and having a threaded free end 332. The connector assembly includes a second part 334 generally in the form of a rectangular plate 336 having an opening 338 therethrough for receiving therethrough the threaded end 332 of hook formation 326 of the first part 320 so that a nut 340 can be threaded on the free end 332 to fasten the first and second parts together. A major portion of plate 336 engages the upper surface of flooring 324 and is substantially co-planar with plate 322. The end portion 342 of plate 336 is bent or angled slightly, as shown in FIG. 15, and terminates in a lip or end flange 344 which contacts the upper surface of plate 322. This provides a positive engagement between the two parts when nut 340 is tightened and precludes any sagging of the parts.

The connector assembly of FIGS. 15 to 17 is installed in the following manner. First the part 320 is manipulated to insert hook formation 326 through the slot 325 in flooring 324 around cable 330 and back up through the slot 325 in flooring 324. Next, the second part 334 is positioned to receive threaded end 332 through opening 338 whereupon nut 340 is installed and tightened on end 332 to fasten the assembly together. This assembly securely holds the flooring panels onto the platform support cables.

Figure 20:
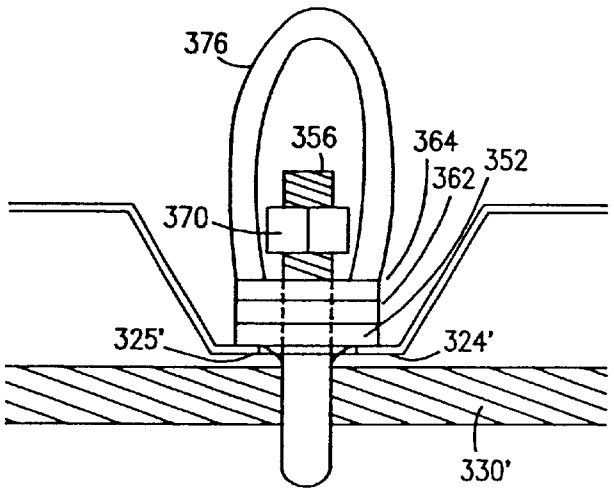
FIG. 20 is a fragmentary end elevational view thereof.
Figure 18:
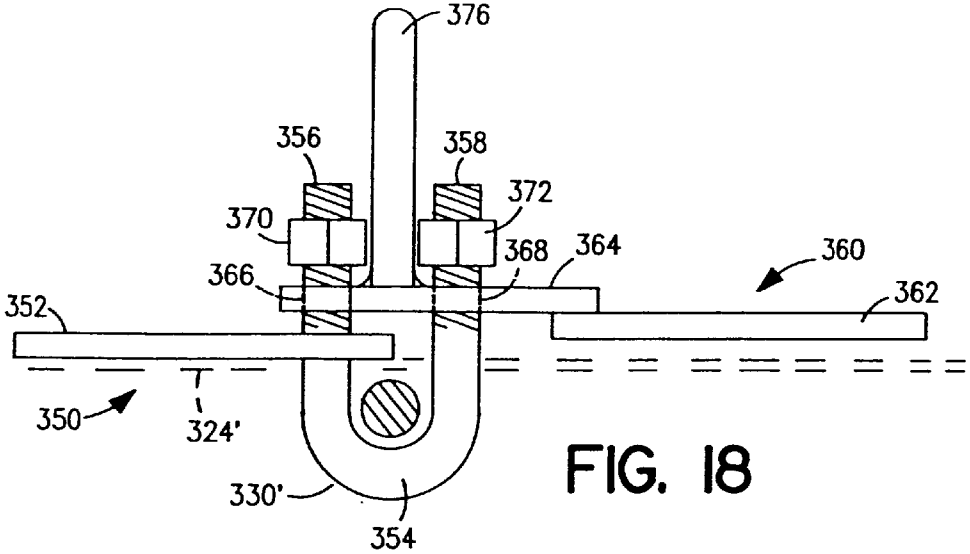
FIG. 18 is a fragmentary side elevational view of a connector assembly according to another embodiment of the present invention.
Figure 19:
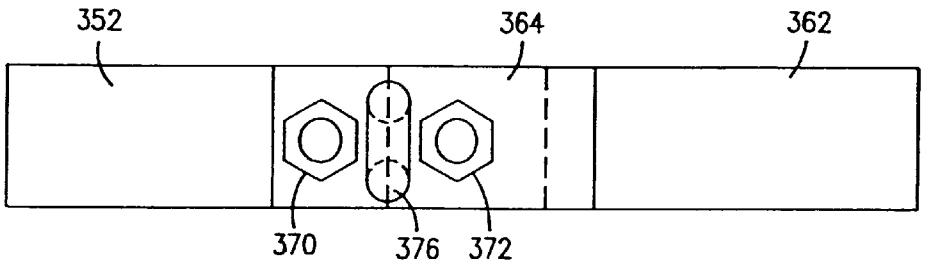
FIG. 19 is a plan view thereof.

Another form of connector assembly according to the present invention is shown in FIGS. 18 to 20 and includes provision for connection to auxiliary cables for extra support. The connector assembly includes a first part 350 in the form of a rectangular plate 352 which engages the upper surface of the platform flooring, indicated at 324' in FIG. 18, and a substantially U-shaped hook formation 354 which extends through body 352 for engaging one of the cables, designated 330' in FIG. 18, and having a pair of threaded free ends 356 and 358. The connector assembly includes a second part 360 including a pair of rectangular plates 362 and 364 welded together in overlapping relation along the ends thereof to define a step-like structure. Plate 364 is provided with a pair of openings 366 and 368 therethrough to receive therethrough the threaded ends 356 and 358 respectively of hook formation 354 of the first part 350 so that nuts 370 and 372 can be threaded on the free ends 356 and 358 respectively to fasten the first and second parts together. Plate 352 of the first part 350 and plate 364 of the second part 360 contact the upper surface of flooring 3241 when the parts are fastened together, and the lower surface of plate 362 in the vicinity of opening 366 contacts the upper surface of plate 352 to provide a stable structure. A hook or loop formation 376 is welded on the upper surface of plate 362 to provide connection to an auxiliary support cable (not shown) extending from the bridge deck or steel structure.

The connector assembly of FIGS. 18 to 20 is installed in the following manner. First the part 350 is manipulated to insert hook formation 354 through the slot 325' in flooring 324' around cable 330' and back up through the slot 325' in flooring 324'. Next the second part is positioned to receive threaded ends 356 and 358 through openings 366 and 368 respectively in plate 362 whereupon nuts 370 and 372 are installed and tightened on ends 356 and 358 respectively to fasten the assembly together. This connector assembly securely holds the flooring panels onto the platform support cables. In addition, an auxiliary support cable (not shown), secured at one end to the bridge deck or steel structure, is provided with an eye hook on the opposite end which is hooked onto formation 376 to provide extra support for the platform. In the connector assembly of FIGS. 18 to 20, the auxiliary cable (not shown) is pulling the assembly upwardly in line with the platform supporting cable 330' thereby providing a balanced arrangement which avoids any torquing or bending of parts of the assembly of the auxiliary cable connection offset from the location of the supporting cable.

Another form of connector assembly according to the present invention is shown in FIGS. 21 to 23 and is characterized by a manually-operated lever for tightening the connector and supporting cable together. The connector assembly includes a first part 380 in the form of a spacer plate 382 having an elongated slot 384 therein which corresponds in size to the slot 325" in flooring 324". The length and width of spacer plate 382, however, are sufficient for plate 382 to cover slot 325". The connector assembly includes a second part 388 for engaging supporting cable 330" and which is generally in the form of a hook. In particular, part 388 includes a central body portion 390, a curved, hooked-shaped portion 392 extending from one end of body 390 and shaped to engage cable 33011, as shown in FIG. 21, and a connector portion 394 extending from another end of body 390. The connector assembly also includes a lever or operator member 400 pivotally connected to connector portion 394 of the second part 388. Lever 400 has a first position shown in solid lines in FIG. 21 which tightens the second part 388 against cable 330" and a second position shown in broken lines in FIG. 21 which releases the second part from cable 330". In particular, lever 400 has a generally U-shaped end-wise configuration, as shown in FIG. 22, having a pair of spaced-apart flange-like sections 404 and 406 joined by a curved central web-like section 408. Each flange section, for example, section 404 shown in FIG. 21, includes an operator portion 410 having a curved, cam-like surface 412 for bearing against the upper surface of spacer plate 382 in the locked position shown in solid lines in FIG. 21, and a handle or grip portion 414 extending from operator portion 410. Lever 400 is pivotally connected to part 388 by means of a bolt 418 which extends through aligned apertures in the end of connector portion 394 of part 388 and in the sections 404 and 406 of lever 400.

The connector assembly of FIGS. 21 to 23 is installed in the following manner. Spacer plate 382 is placed in position and part 388 is inserted through slot 384 in spacer plate 382 and slot 325" in flooring 324", and the hook-shaped portion 392 is engaged on cable 330", as shown in FIG. 21. During this operation, lever 400 is in the broken line position shown in FIG. 21. Next, lever 400 is moved by hand to the solid line position of FIG. 21. This applies downward force on spacer plate 382 and pulls hook portion 392 upwardly against cable 330" thereby tightening the assembly. As a result, the connector assembly securely holds flooring 324" on the supporting cable 330". A pin 422 or nut and bolt can be inserted through the aligned apertures 424 and 426 in flange sections 404 and 406 respectively to hold lever 400 in place for added safety. When it is desired to disassemble the arrangement or to remove a flooring section, pin 422 is removed and lever 400 simply moved to the broken line position of FIG. 21 whereupon the part 388 is removed from contacting cable 330".

The connector assembly of FIGS. 21 to 23 has the advantages that no welding of parts is required, it can be assembled prior to installation on the work platform, i.e. does not have to be assembled on site, it is relatively light in weight, and it is relatively easy and quick to install.

The platform sections or panels 300 and the connector assemblies are installed to provide a completed platform 30 in the following manner. The panels 300 are placed and arranged on the cables 70 by workmen using scaffolds or the like supported by the bridge 10. Panels 300 are placed on the supporting cables 70 so that the corrugations 306 are disposed transversely of the cables 70. Panels 300 are arranged in a row and in end-to-end overlapping relation transversely of the cables 70. The panels 300 are located so that the openings are aligned with various ones of the cables 70. Furthermore, with adjacent ones of the panels 300 being in end-to-end overlapping relation, the openings of the overlapping portions of adjacent panels 300 in a row are aligned with each other and with the corresponding cables 70.

Next, the connector assemblies are installed manually by the workmen. The connector assemblies can be any of the connector assemblies described in connection with FIGS. 15 to 23 and 26 to 28, and they are installed in the manner previously described. The foregoing operation is repeated for each of the connector assemblies in each of the panels along the row. Then the panels 300 of the next row are installed, the row extending transversely of the cables 70 and the panels of the next row being adjacent sideways to the panels of the first row. The panels of this next row are in end-to-end overlapping relation in the same manner as the panels of the first row. In addition, the panels of this next row are in side-to-side overlapping relation with the panels of the first row, as shown in FIG. 3. The connector assemblies are installed in the panels of this next row in a manner similar to that of the first row. The foregoing installation of rows of panels 300 and installation of connector assemblies is continued in a direction longitudinally of the cables 70 until the platform 30 is completed. Connector assemblies of the type shown in FIGS. 18 to 20 are installed at spaced locations, for example, about 20 feet, over the surface of platform 30, and auxiliary cables such as cables 32 are connected between those assemblies and bridge structural steel 32.

By way of example, in an illustrative platform, the overall width is about 32 feet or slightly less than the width of the bridge deck 12, and the overall length of the platform is about 140 feet, which is approximately the span between piers 18 and 20. Panels 300 are rigid type B corrugated steel decking panels each 11 feet in length and 3 feet in width. The panels 300 are 22 gage, 1½ inch deep ASTM A446 steel having a yield strength of FY=33KSI (minimum). A minimum panel overlap of 6 inches in longitudinal and lateral directions is provided. Cables 70 are seven in number, each ½ inch in diameter and spaced apart about 5 feet. Cables 70 are 6×19 IWRC cable of plain steel with a breaking strength of 41,200 pounds or greater. Each panel 300 is connected at two locations to the corresponding cable. The location of platform 30 is about 11½ feet below bridge deck 12. The typical maximum applied load for which platform 30 is designed is 11 pounds per square foot. The cables 70 are supported every 20 feet by the auxiliary support cables such as those designated 32.

Platform 30 of the present invention, by virtue of the combination of support cables 70 and corrugated decking panels 300, is provided to be safe, provide a sufficiently rigid support for workmen to stand and walk on, and to be relatively simple in structure and light in weight. Rigidity is important in that workmen can walk along platform 30 with no lowering. The corrugations 306 enhance the strength to weight ratio of panels 300. In addition, the corrugations facilitate containment of debris. The connector assemblies in cooperation with the openings in the panels are provided to achieve a quick, easy, and effective way to both erect and dismantle the bridge platform of the present invention. The individual panels 300 releasably connected to cables 70 are provided for convenient and quick access through the flooring 74 in emergency situations. Thus, in such situations, it is not necessary to cut through the platform flooring which otherwise could destroy the integrity of debris containment provided by enclosures, such as that shown in FIG. 16. Furthermore, the time required to cut through flooring could have serious consequences in emergency and critical situations, and such cutting could impair the structural integrity of the platform and therefore its safety.

Figure 24:
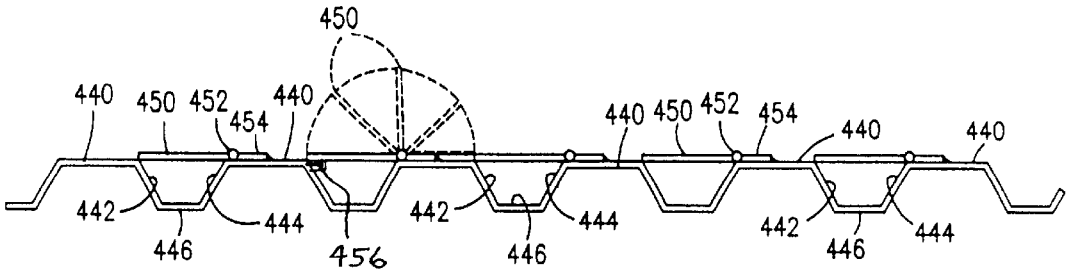
FIG. 24 is a side elevational view of an alternative form of flooring for the work platform of the present invention.
Figure 25:
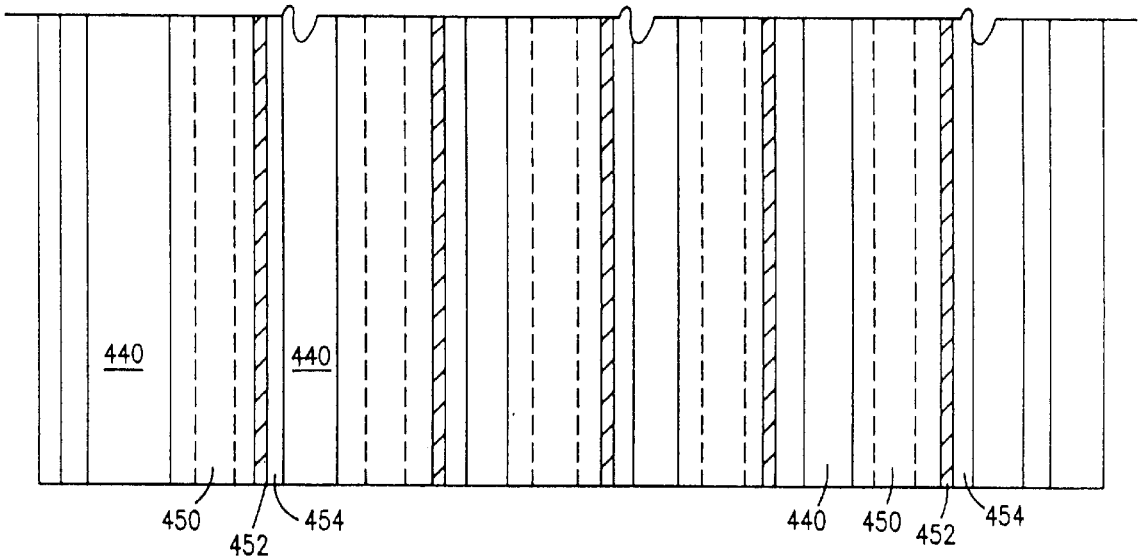
FIG. 25 is a plan view thereof.

FIGS. 24 and 25 show an alternative form of flooring for the work platform of the present invention. The corrugated decking panels of flooring 74 include a series of flat upper surfaces, designated 440 in FIG. 24, which are separated by a series of troughs or depressions defined by downwardly inclined walls 442 and 444 which meet flat lower surfaces 446. The connector assemblies previously described are located in the troughs below the plane of the upper surfaces 440. In order to provide a more flat surface to walk on and to move equipment therealong, the flooring is modified by providing a series of flat, plate-like covers 450 for covering the troughs or depressions between the surfaces 440. In particular, each cover 450 comprises a thin rectangular plate 450 having a length equal to that of flooring 74 and a width slightly greater than the maximum width of a trough or depression in flooring 74.

Without such covers, the panels are compactly nestable so as to take up little space for storage and transport. With the covers covering the troughs, the panels are not nestable and thus take up a great deal of space (on an order of 5 to 10 times as much space or more) which significantly increases the storage and transport cost. In order to make the panels nestable for storage and transport compactly while providing the desired flat surfaces to the flooring made therewith, in accordance with an aspect of the present invention, the covers 450 are hingedly connected to the panels. Thus, one edge of cover 450 is joined to a hinge 452 which, in turn, is joined to a plate 454 of relatively shorter width and of the same length as plate 450 and which is fixed such as by welding to the adjacent upper surface 440 of the flooring. Actually, the entire combination may be viewed as a hinge with plates 450 and 454 each being a hinge leaf and joined by the hinge knuckle assembly 452. The foregoing is provided on each of the troughs or depressions defined in flooring 74. If desired, a strip of magnetic material, illustrated at 456, can be provided along the lower portion of the free edge of each cover 450 to hold the cover down and prevent lifting as persons walk along flooring 74. Thus, after the connector assemblies are installed, each of the hinged covers 450 is flipped over to the position shown in FIG. 24 covering its corresponding corrugation thereby providing a flat uniform surface which is easier to walk on and move equipment therealong. In addition, by covering the corrugations, debris is confined to the flat upper surface, making cleanup easier. When a project is completed and the platform disassembled, the covers 450 are flipped to positions uncovering the troughs respectively and then compactly nested for transport and storage.

While the panels of flooring 74 are described herein for use as scaffold flooring, other uses are envisioned for such panels, for example, to provide a wall wherein insulation may be disposed in the enclosed or covered corrugations or for acoustics purposes.

Figure 27:
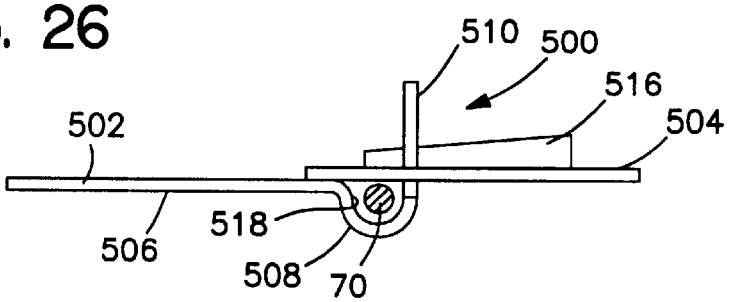
FIG. 27 is a view similar to that of FIG. 21 of a connector assembly according to another embodiment of the present invention.
Figure 28:
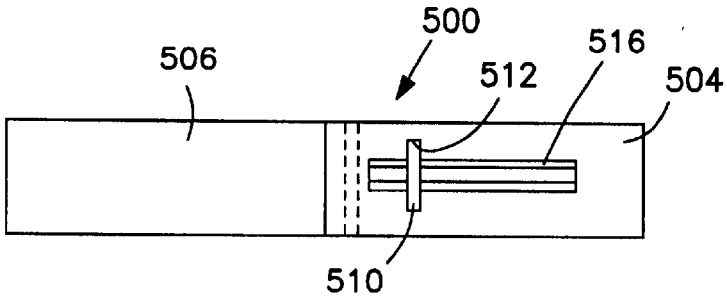
FIG. 28 is a plan view of the connector assembly of FIG. 27.

Referring to FIGS. 26 to 28, There is shown generally at 500 an alternative embodiment of the connector assembly, which includes members or parts 502 and 504. The first part 502 has a generally flat body portion 506 which engages the upper surface of the respective panel 300, a substantially hook-shaped portion 508 which extends from the body portion 506 and downwardly into the respective opening or slot 325 to receive the respective cable 70, and a free end portion 510 which extends upwardly out of the slot. The second part 504 is generally flat and overlies part of the portion 506 and the slot 325 and has an opening, illustrated at 512, for receiving the free end portion 510. Part 504 and portion 506 have a width greater than that of the generally rectangular slot 325 in order to suitably overlie the slot. Portions 508 and 510 have a reduced width in order that portion 508 may be received in slot 325 and portion 510 may be received in opening 512. The parts 502 and 506 are connected, as hereinafter described, to form what may be called an eyelet, illustrated at 518, for securely receiving the cable 70 for passage thereof therethrough, and a formation (not shown), similar to formation 376, may be provided for attachment of an auxiliary tie-up cable such as shown at 32 in FIG. 1.

Figure 29:
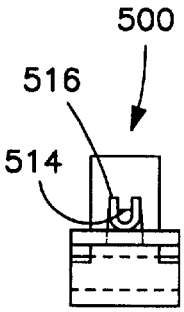
FIG. 29 is an end view of the connector assembly of FIG. 27.

In order to eliminate a welding step so that the cost of the product may be reduced, the part 502 is made from a single piece, i.e., by suitably cutting a plate to the flat shape corresponding to the and bending it to the finished product form, such as shown in FIGS. 27 to 29.

Free end portion 510 has an opening or slot, illustrated at 514, whose bottom wall is approximately level with the upper surface of portion 506 and which extends above the part 504 when the connector is assembled as shown in FIGS. 27 to 29. The application and removal of nuts to and from the connectors is a time consuming process, especially the removal of nuts which may have rusted to the bolts, and the threads may also become damaged. In order to make the assembly and disassembly of the connector 500 easier and faster, in accordance with an aspect of the present invention, the parts 502 and 504 are connected together by a wedge 516 inserted into the opening 514 and driving it into place with a hammer. This also desirably eliminates the costly process of providing a threaded portion on the part 502 and the necessity of replacing parts whose threads become damaged. The wedge 516 is a generally U-shaped member with the bottom of the "U" resting on the part 504 when the connector is assembled. When it is time to disassemble the connector, it may just as easily and quickly be disconnected by merely striking the wedge 516 with a hammer.

Referring to FIGS. 30 to 34, there is illustrated generally a platform means in accordance with another embodiment of the present invention. FIGS. 30 to 32 and FIG. 33 show two different assemblies 600 and 601 respectively of the platform using generally the same parts. Thus, except as noted, the following description applies equally to both assemblies. It is considered difficult to clean up debris which accumulates on the floor of a platform. In order to congregate the debris at the center of the platform where it can be more easily removed, in accordance with another embodiment of the present invention, the platform 600 is assembled to have a pair of inclined floor portions 602 which meet generally along a longitudinal centerplane, illustrated at 604, and a gutter 606 is attached to the floor portions as described hereinafter. A suitable angle of inclination, illustrated at 608, may be, for example, about 10 degrees. A suitable vibrator, illustrated at 610, is suitably attached to each floor portion 602 to vibrate the debris toward the gutter 606.

Figure 31:
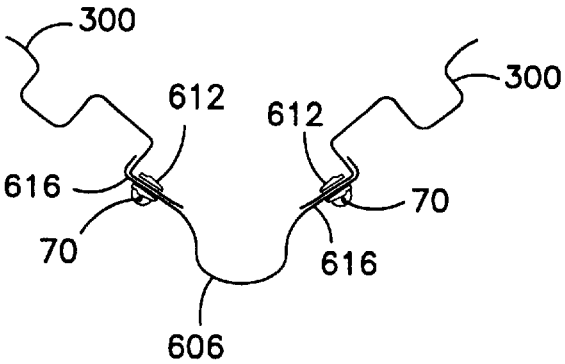
FIG. 31 is an enlarged partial sectional view of the work platform of FIG. 30.

Each floor portion 602 is assembled similarly as described elsewhere in this specification, i.e., panels 300 are laid side-by-side on cables 70 which pass through eyelets 518 formed by connectors 612, which may be any of the connectors heretofore shown and described, and auxiliary tie-up cables 32 are attached between the connectors 612 and existing bridge stringers 276 by means of a beam flange clamp hanger 614 or other suitable means. Other suitable auxiliary support means may be provided such as, for example, rigid tie-up assemblies, which comprise one tube telescopingly received within another tube to allow adjustment to the correct height. The upper end of one tube is connected to a bridge stringer 276, and the lower end of the other tube is connected to the respective connector 612. The tubes each have a number of apertures spaced over its length, and, after a pair of apertures in the tubes are aligned at the adjusted position, a pin is inserted in the aligned apertures. A suitable perimeter protection structure, illustrated at 615, may be suitably erected along the sides of the floor portions. As seen in FIG. 31, the gutter 606, which is a suitable shaped piece of sheet metal, has edge portions 616 which engage edge portions of the panels 300 and attached together by the connectors 612.

Figure 30:
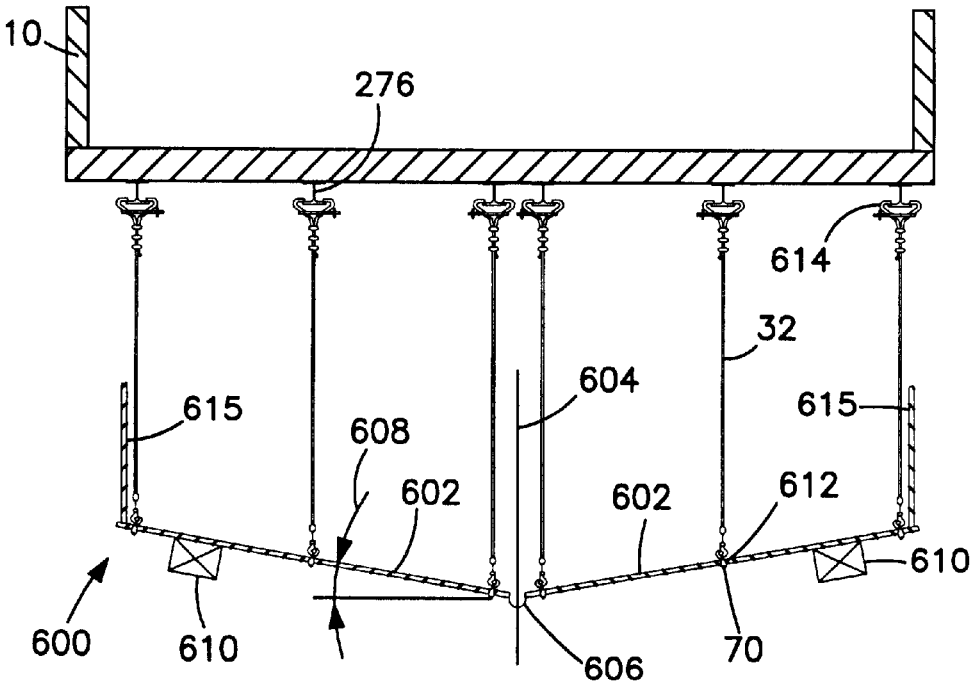
FIG. 30 is partially schematic sectional view of a work platform in accordance with an alternative embodiment of the present invention.
Figure 32:
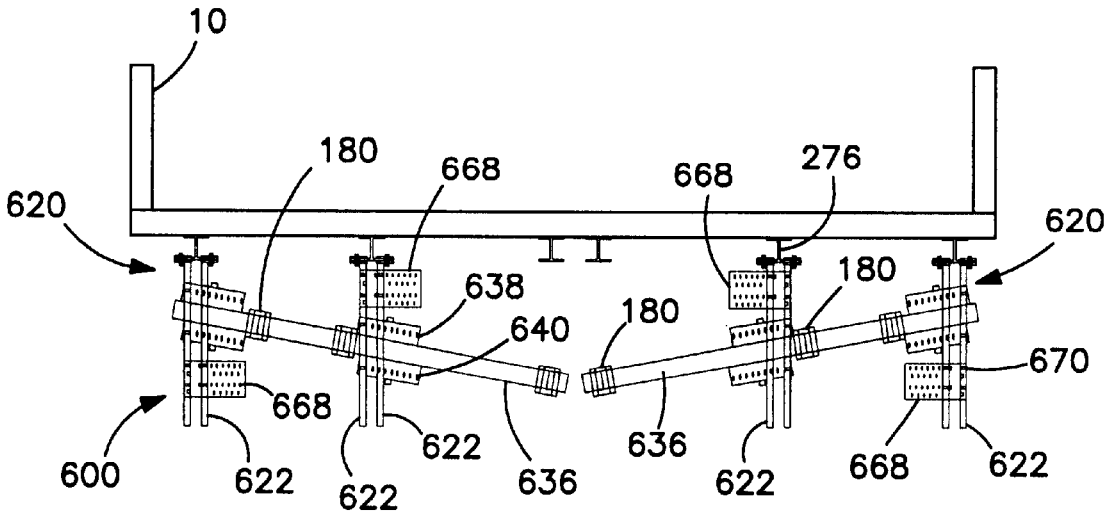
FIG. 32 is an end view of the work platform of FIG. 30.
Figure 33:
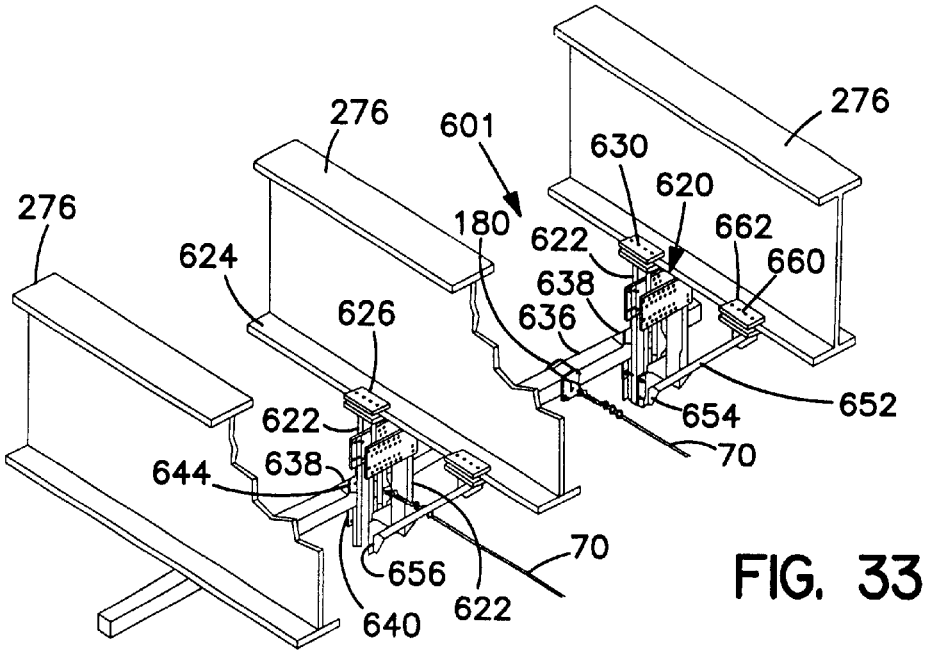
FIG. 33 is a partial perspective view of the work platform of FIG. 30.
Figure 34:
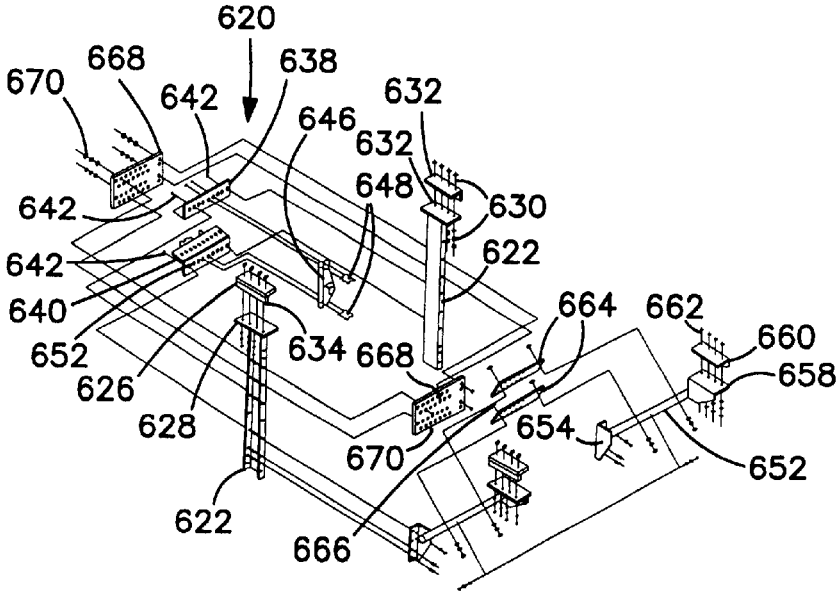
FIG. 34 is a partial exploded view of the work platform of FIG. 30.

FIGS. 32 to 34 show beam bracket assemblies, illustrated generally at 620, for attaching the cables 70 at one end to the existing bridge structure, i.e., girders 276, so as to adjustably allow flexibility in placement of the platform portions 602 in height and spacing of the cables as well as at any desired angle 608 of inclination, i.e., inclined, as shown in FIGS. 30 to 32, including level, as shown in FIG. 33. It should be understood that like assemblies are provided for attaching the cables at their other ends. In FIGS. 30 to 32, one of the assemblies 620 is for attaching the cables for one of the floor portions 602, and the other assembly is for attaching the cables for the other floor portion 602. Thus, for the inclined platform of FIGS. 30 to 32, there are 4 assemblies which may be identical, but may not necessarily be identical, and the platform, whether inclined or level, may be erected differently using substantially the same components due to the particulars of the bridge structure. Each assembly 620 comprises a pair of posts 622 attached to opposite flanges 624 of one bridge stringer or girder 276 each by means of an upper flanged plate 626 and a lower plate 628 to which the post is welded or otherwise suitably attached to extend downwardly therefrom. Each assembly 620 also comprises another pair of posts 622 similarly attached to opposite flanges 624 of another girder 276. Each girder flange 624 is sandwiched between the respective plates 626 and 628, which have portions 632 which extend outwardly of the flange 624. The flange 634 on the outer portion 632 of the upper plate 626 engages the outer portion 632 of the. lower plate, and bolt and nut fasteners 630 are applied to the outer portions 632 to clamp the flange 624 between the plates 626 and 628. Such a means for attaching the vertically downwardly extending posts 622 desirably allows for various girder flange thicknesses and widths.

Figure 35:
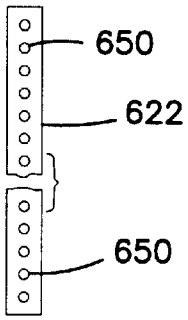
FIG. 35 is an elevation side view of a post for the work platform of FIGS. 32 to 34.

A cable support beam 636 extends generally cross-wise to the posts 622 and is adjustably attached thereto by means, for each post, of upper and lower brackets 638 and 640 which are attached (by nut and bolt fasteners 642 or other suitable means) to both posts for the respective girder and between which the cable support beam 636 is sandwiched and attached (by nut and bolt fasteners 644 or other suitable means). Whereas two support beams 636 are used for the inclined platform 600 of FIGS. 30 to 32, a single support beam is preferred for the level platform 601 of FIG. 33. The lengths of the support beams 636 will of course depend on the desired width of the platform. A cable attachment bracket 646 to which an end of a cable 70 is suitably attached is optionally disposed between a pair of posts 622 and attached to the brackets 638 and 640 by nut and bolt fasteners 648 or other suitable means. Each post 622 has a number of holes, illustrated at 650 in FIG. 35, along its length (and the brackets also have a number of holes 652) for receiving bolts to allow the cable support beam 636 to be adjustably mounted at various heights as desired, including inclining the brackets 638 and 640, as illustrated in FIG. 32, to achieve a desired angle 608 of inclination of the floor portions 602.

A plurality of cable connector assemblies 180 are spaced along each of the support beams 636 and to which the ends of the cables 70 are attached. As more fully discussed with reference to FIG. 6, each assembly 180 comprises a shackle plate to which the respective cable is connected and a second plate connected to the shackle plate, the plates clampingly connected to the support beam 636 which is sandwiched therebetween.

In accordance with the present invention, the position of each of the cable connector assemblies 180 is adjustable along the length of the respective support beam 636 so that the number and spacings of the cables 70 may be varied as desired by merely loosening the assembly 180 and sliding it along the support beam 636.

In order to brace the beam bracket assembly 620 against the forces applied by the cables, a bracing beam 652 is suitably attached such as by means of a suitable bracket 654 welded thereto and nut and bolt fasteners 656 to the lower end portion of each post 622 and extends therefrom upwardly and inwardly (in a direction toward the other. end of the platform) at an angle with the vertical of, for example, about 45 degrees to the respective bridge girder flange 624. The bracing beam 652 is connected to the flange 624 similarly as the post is connected, i.e., by a plate 658 welded to the bracing beam and a flanged plate 660, which are similar to plates 628 and 626 respectively, and by nut and bolt fasteners 662 or other suitable means. A pair of spaced plates 664 are each attached to the respective pair of bracing beams 652 by suitable means such as nut and bolt fasteners 666 to keep them from spreading apart and otherwise brace them. A pair of plates 668, spaced from brackets 626 and 628, are attached to opposite sides of the respective pair of posts 622 by suitable means such as nut and bolt fasteners 670 to, along with the brackets 638 and 640, keep them from spreading apart and otherwise brace them. Depending on the position of the brackets 638 and 640, the plates 668 may be positioned below the brackets 638 and 640, as seen for the outer posts 622 in FIG. 32, or above the brackets 638 and 640, as seen for the inner posts 622 in FIG. 32 and in the assembly of FIG. 33.

The assemblies of FIGS. 30 to 32 and of FIG. 33 are of substantially the same components assembled differently. In order to allow such flexibility as well as the flexibility of attaching the platform to bridge structures of various sizes and shapes, the various brackets and plates and posts have a multiplicity of fastener receiving holes to allow for various differences in bridge structure dimensions as well as various differences in shapes of platforms to be erected.

It should be understood that, while the present invention has been described in detail herein, the invention can be embodied otherwise without departing from the principles thereof, and such other embodiments are meant to come within the scope of the present invention as defined by the appended claims.

What is claimed is:

1. A structure comprising a corrugated panel having a plurality of troughs, a plurality of side walls and a plurality of bottom walls wherein a pair of said side walls and a corresponding one of said bottom walls defines a trough, a plurality of upper top walls extending between said troughs respectively, and a plurality of cover members for covering said troughs respectively, each of said cover members having a width equal substantially to a distance between said respective side walls and hingedly connected to a respective said upper top wall for movement between a first position to cover said perspective trough and a second position wherein said respective trough is uncovered.

2. A structure comprising a corrugated panel having a plurality of troughs a plurality of side walls and a plurality of bottom walls wherein a pair of said side walls and a corresponding one of cover said bottom walls defines a trough, a plurality of upper top walls extending between said troughs respectively, and a plurality of members for covering said troughs respectively, each of said cover members having a width equal substantially to a distance between said respective side walls and hingedly connected to a respective said upper top wall for movement between a first position to cover said respective trough and a second position wherein said respective trough is uncovered, and the structure further comprising at least one magnet for magnetically securing at least one of said cover members to at least one of said upper top wall in at least one of said covered and uncovered positions.

3. A structure according to claim 2 further comprising at least one opening in at least one of said bottom walls of said panel for attaching said panel to a supporting member.

4. A structure comprising a corrugated panel having a plurality of troughs a plurality of side walls and a plurality of bottom walls wherein a pair of said side walls and a corresponding one of said bottom walls defines a trough, a plurality of upper top walls extending between said troughs respectively, and a pluality of cover members for covering said troughs respectively, each of said cover members having a width equal substantially to a distance between said respective side walls and hingedly connected to a respective said upper top wall for movement between a first position to cover said respective trough and a second position wherein said respective trough is uncovered, the structure further comprising at least one opening in at least one of said bottom walls of said panel for attaching said panel to a supporting member.

* * * * *